US008666271B2

(12) United States Patent
Saiki

(10) Patent No.: US 8,666,271 B2
(45) Date of Patent: Mar. 4, 2014

(54) IMAGE FORMING APPARATUS AND STORAGE MEDIUM FOR IMAGE QUALITY STABILIZATION

(75) Inventor: Tomoyuki Saiki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 377 days.

(21) Appl. No.: 13/117,035

(22) Filed: May 26, 2011

(65) Prior Publication Data

US 2011/0293304 A1 Dec. 1, 2011

(30) Foreign Application Priority Data

May 31, 2010 (JP) ..... 2010-125246

(51) Int. Cl.
*G03G 15/00* (2006.01)
*G03G 15/01* (2006.01)

(52) U.S. Cl.
USPC ..... 399/49; 399/301

(58) Field of Classification Search
USPC ..... 399/49, 72, 301
See application file for complete search history.

(56) References Cited

U.S. PATENT DOCUMENTS 7,587,157 B2 * 9/2009 Matsuda et al. ..... 399/301

FOREIGN PATENT DOCUMENTS

JP 2007-108246 A 4/2007

* cited by examiner

*Primary Examiner* — William J Royer
(74) *Attorney, Agent, or Firm* — Canon USA Inc. IP Division

(57) ABSTRACT

An image forming apparatus is capable of more directly solving a problem of unevenly formed line images. The image forming apparatus includes a rotatable photosensitive member, a light emission unit configured to emit a laser beam based on image information, and a transfer unit configured to transfer a toner image developed on the photosensitive member. The image forming apparatus acquires variable speed information, which indicates a variable rotation speed of the photosensitive member. In addition, the image forming apparatus executes image position correction on the image information based on the acquired variable speed information.

13 Claims, 19 Drawing Sheets

CONVEYANCE DIRECTION OF INTERMEDIATE TRANSFER MEMBER
W
SCAN LINE
1001
1002
SCAN LINE AFTER CORRECTION
1003
1004
1005
1006
1007
1008
TONER IMAGE
1009
1010
DENSITY: 100%
DENSITY: 75%
DENSITY: 50%
DENSITY: 25%
DENSITY: 0%

IMAGE FORMING APPARATUS AND STORAGE MEDIUM FOR IMAGE QUALITY STABILIZATION

BACKGROUND OF THE INVENTION

1. Field of the Invention

The present invention relates to an image quality stabilization method executed by an image forming apparatus.

2. Description of the Related Art

Recently, an electrophotographic image forming apparatus and an inkjet image forming apparatus have been widely used. It is desired by the market that an image forming apparatus of this type be capable of printing an image at a sufficiently high quality.

As one of the causes of image degradation, density unevenness, which may occur in the sheet conveyance direction (sub scanning direction), may occur during image forming. In order to prevent density unevenness in the sub scanning direction, Japanese Patent Application Laid-Open No. 2007-108246 discusses the following method.

More specifically, the method discussed in Japanese Patent Application Laid-Open No. 2007-108246 previously measures the level of density unevenness in the sub scanning direction that occurs according to the cycle of an outer periphery of a photosensitive member (photosensitive drum) in association with the phase of the photosensitive member. Furthermore, the method discussed in Japanese Patent Application Laid-Open No. 2007-108246 stores the result of the measurement on a storage unit in a density pattern information table.

Then, information about density unevenness, which has been associated with the phase of the photosensitive member during image forming, is read from the density pattern information table. If a high density is acquired, the method discussed in Japanese Patent Application Laid-Open No. 2007-108246 lowers the image forming density. In other words, Japanese Patent Application Laid-Open No. 2007-108246 discusses reverse density correction control.

To describe the above-described phenomenon of density unevenness in more detail, the variation of a rotation speed of the photosensitive member may be one of the specific causes of density unevenness in the sub scanning direction. To paraphrase this, if the rotation speed of the photosensitive member is low, the position of an electrostatic latent image formed on the photosensitive member may shift in the rotational direction of the photosensitive member (in the upstream direction of the image). Accordingly, the interval between static image lines may decrease.

On the other hand, if the rotation speed of the photosensitive member is high, the electrostatic latent image is displaced in a direction reverse to the rotational direction of the photosensitive member (in the downstream direction of the image). Accordingly, in this case, the interval between static image lines may increase.

Furthermore, if the rotation speed of the photosensitive member is low when the toner adhered to the electrostatic latent image forming position is primarily transferred from the photosensitive member to an intermediate transfer member, then the position of the image after the primary transfer shifts in a reverse direction of the rotational direction of the photosensitive member (i.e., in the downstream direction of the image). Accordingly, in this case, the interval between static image lines may increase.

On the other hand, if the rotation speed of the photosensitive member is high, the position of the image after the transfer shifts in the rotation direction of the photosensitive member (in the upstream direction of the image). Accordingly, the interval between line images may decrease.

As described above, an electrostatic latent image and an image may be displaced due to the variation of the rotation speed of the photosensitive member. Accordingly, the density of the image formed on the intermediate transfer member may become uneven. To macroscopically observe an image having an uneven density, the density of a region in which the image has been highly densely formed may appear to be high. On the other hand, the density of another region in which the image has been loosely formed may appear to be low. As a result, an observer of the image may recognize that density unevenness has occurred on the image.

As described above, in order to primarily prevent density unevenness, Japanese Patent Application Laid-Open No. 2007-108246 discusses a method for correcting the uneven density by reverse density correction.

However, the density correction method cannot solve the very problem of uneven intervals between line images. To paraphrase this, it is desired by the market to introduce a method for more directly solving the problem of unevenly formed line images.

SUMMARY OF THE INVENTION

According to an aspect of the present invention, an image forming apparatus which includes a rotatable photosensitive member, a light emission unit configured to emit a laser beam to the photosensitive member based on image information, and a transfer unit configured to transfer a toner image developed on the photosensitive member by the laser beam emitted by the light emission unit onto a member to be transferred, includes an acquisition unit configured to acquire variable speed information, which indicates a variable rotation speed of the photosensitive member, and an image position correction unit configured to correct an image position according to the variable rotation speed based on the variable speed information that has been acquired by the acquisition unit by executing image processing on the image information.

According to an aspect of the present invention, the problem of unevenly formed line images can be more directly solved.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

DESCRIPTION OF THE EMBODIMENTS

Various exemplary embodiments, features, and aspects of the invention will be described in detail below with reference to the drawings.

An image forming apparatus according to an exemplary embodiment of the present invention, which can solve density unevenness of an image to be formed by correcting the very displacement of an image to prevent density unevenness, will be described in detail below with reference to the attached drawings. Components, units, portions, methods, or the like are mere examples of the present invention. In other words, the following exemplary embodiment of the present invention can be appropriately altered or modified within the scope of the present invention.

Figure 1:
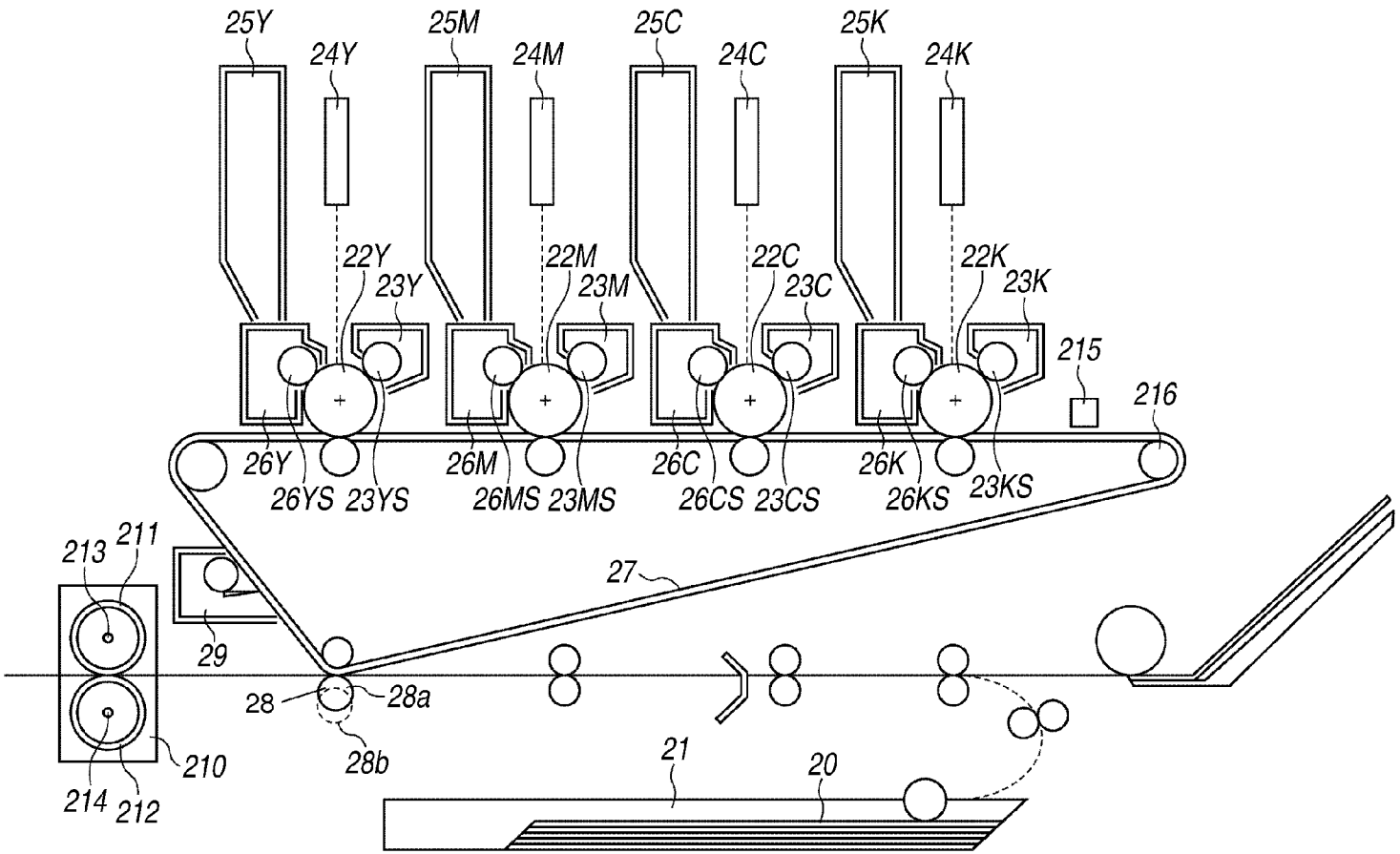
FIG. 1 is a cross section of a color image forming apparatus according to an exemplary embodiment of the present invention.

FIG. 1 is a cross section of a color image forming apparatus according to a first exemplary embodiment of the present invention.

Referring to FIG. 1, the color image forming apparatus forms an electrostatic latent image by using exposure light (a laser beam) emitted based on image information, which is supplied from an image processing apparatus (not illustrated in FIG. 1). Furthermore, the color image forming apparatus forms a single-color toner image by developing the electrostatic latent image.

In addition, the color image forming apparatus forms single-color toner images of each color and transfers the toner images to a transfer material 20 in a mutually overlapping state. Then the multicolor toner image is fixed on the transfer material 20. The color image forming method will be described in detail below.

A paper feed unit 21 feeds the transfer material 20. Photosensitive drums (photosensitive members) 22Y, 22M, 22C, and 22K include an aluminum cylinder coated with an organic photoconductive layer at the outer peripheral thereof. A drive force from a single drive motor 115 (FIG. 3) (not illustrated in FIG. 1), is transmitted to the photosensitive members 22Y, 22M, 22C, and 22K via a gear provided on a shaft of the drive motor 115 or via other gears. Accordingly, each of the photosensitive members 22Y, 22M, 22C, and 22K is rotated by the drive motor 115.

In the present exemplary embodiment, a single drive motor 115 drives the photosensitive members 22Y, 22M, 22C, and 22K. However, alternatively, a motor that drives each photosensitive member can be used.

An injection charging device charges the photosensitive member. Four injection charging devices 23Y, 23M, 23C, and 23K correspond to four colors of yellow (Y), magenta (M), cyan (C), and black (K), respectively. A sleeve 23YS, 23MS, 23CS and 23KS is provided to each injection charging device as described in FIG. 1 by a circle.

Exposure light (a laser beam) is emitted by a laser diode provided to scanner units 24Y, 24M, 24C, and 24K. The surface of the photosensitive members 22Y, 22M, 22C, and 22K is selectively exposed by the exposure light. An electrostatic latent image is formed at a position on the surface of the photosensitive member irradiated with the laser beam.

The photosensitive members 22Y through 22K rotate with a specific decentration component. However, at a timing of forming the electrostatic latent image, the phase of each photosensitive member 22 has already been adjusted to exert the same decentration effect at a transfer unit.

Each development unit 26 develops and visualizes the electrostatic latent image by using a recording agent (i.e., a toner), which is supplied by each toner cartridge (25Y, 25M, 25C, 25K). Four development units 26Y, 26M, 26C, and 26K correspond to four colors of yellow (Y), magenta (M), cyan (C), and black (K), respectively. Each sleeve 26YS, 26MS, 26CS and 26KS is provided to each development unit. Each development unit is detachably provided onto the photosensitive member 22.

An intermediate transfer member 27, which contacts the photosensitive members 22Y, 22M, 22C, and 22K, is driven and rotated by an intermediate transfer member drive roller 216 in the clockwise direction during color image forming. The intermediate transfer member 27 rotates in synchronization with the rotation of the photosensitive members 22Y, 22M, 22C, and 22K to transfer each single-color toner image on the intermediate transfer member 27.

The intermediate transfer member 27 functions as a member to be transferred. Subsequently, a transfer roller 28, which will be described below, comes in contact with the intermediate transfer member 27 to convey the transfer material 20 by being sandwiched between the transfer roller 28 and the intermediate transfer member 27. In this manner, the multicolor toner image on the intermediate transfer member 27 is transferred onto the transfer material 20.

While the multicolor toner image is transferred on the transfer material 20, the transfer roller 28 contacts the transfer material 20 at a position 28*a*. After printing is completed, the transfer roller 28 moves to a position 28*b* to separate from the transfer material 20.

A fixing device 210 fixes the transferred multicolor toner image on the transfer material 20 by fusing while the transfer material 20 is conveyed. In the example illustrated in FIG. 1, the fixing device 210 includes a fixing roller 211, which applies heat to the transfer material 20. In addition, the fixing device 210 includes a pressure roller 212, which applies pressure to the transfer material 20 to press-contact the transfer material 20 against the fixing roller 211. The fixing roller 211 and the pressure roller 212 have a hollow structure. The fixing roller 211 includes a built-in heater 213 inside. Similarly, the pressure roller 212 includes a built-in heater 214 inside.

The transfer material 20 having the multicolor toner image transferred thereon is further conveyed by the fixing roller 211 and the pressure roller 212. Then, the transfer material 20 is subjected to heat and pressure applied by the fixing roller 211 and the pressure roller 212, respectively, to fix the toner images on the surface of the transfer material 20.

After the toner images are fixed thereon, the transfer material 20 is discharged by a discharge roller (not illustrated) onto a paper discharge tray (not illustrated). Then the image forming operation ends.

A cleaning unit 29 cleans up the toner that remains on the intermediate transfer member (member to be transferred) 27. Waste toners that remain after four-color multicolor toner images are transferred from the intermediate transfer member 27 onto the transfer material 20 are collected into a cleaner container.

A density sensor (hereinafter may also be referred to as an "optical performance detection sensor") 215 is provided within the image forming apparatus illustrated in FIG. 1 to face the intermediate transfer member 27. The density sensor 215 measures the density of a toner patch formed on the surface of the intermediate transfer member 27.

In the example illustrated in FIG. 1, the color image forming apparatus includes the intermediate transfer member 27. However, alternatively, an exemplary embodiment of the present invention can be implemented by an image forming apparatus that employs a primary transfer method, by which a toner image developed on a photosensitive member 22 is directly transferred onto the transfer material. If the alternative configuration is employed, the present invention can be implemented by substituting the intermediate transfer member 27 in the following description with a transfer material conveyance belt (transfer material carrying member).

In addition, in the following description, a direction perpendicular to a main scanning direction for scanning an image when viewed from above is referred to as a "conveyance direction" (a sub scanning direction). In other words, a direction of conveying the transfer material and the rotation direction of the intermediate transfer member may be referred to as the conveyance direction (the sub scanning direction).

An example of the density sensor 215, which is the optical performance detection sensor, will be described below with reference to FIGS. 2A and 2B.

Figure 2A:
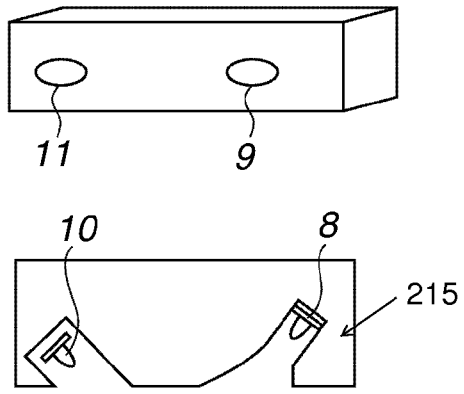
FIGS. 2A and 2B illustrate an example of an optical performance detection sensor.

Referring to FIG. 2A, the density sensor 215 is constituted by a light-emitting diode (LED) 8, which is alight emission element, and a phototransistor 10, which is a light-sensitive element. Light emitted from the LED 8 reaches the surface of the intermediate transfer member 27 via a slit 9, which suppresses diffused light. By restricting irregular reflection light by an aperture 11, regular reflection components of the light are received by the light-sensitive element 10.

Figure 2B:
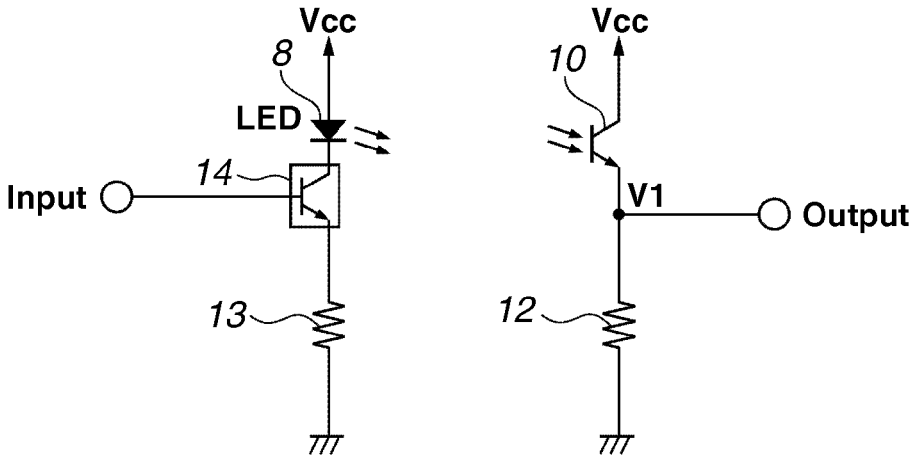

FIG. 2B illustrates an exemplary circuitry configuration of the density sensor 215. Referring to FIG. 2B, a resistor 12 and the light-sensitive element 10 divide a voltage Vcc. A resistor 13 restricts a current for driving the LED 8. A transistor 14 toggles the LED 8 on and off according to a signal from a central processing unit (CPU).

In the circuit illustrated in FIG. 2B, if the amount of regular reflection light from the toner image when the light is emitted by the LED 8 is large, the current that flows into the light-sensitive element 10 increases. As a result, a value of a voltage V1, which is detected as an output, becomes large.

More specifically, in the circuitry configuration illustrated in FIG. 2B, if the density of the toner patch is low and the amount of the regular reflection light is large, the detected voltage V1 becomes high. On the other hand, if the density of the toner patch is high and the amount of the regular reflection light is small, the detected voltage V1 becomes low. The density value can be calculated based on the detected voltage.

Now, functions provided to suppress the level of density unevenness will be described in detail below with reference to FIG. 3. The following various processing is executed to each color of Y, M, C, and K. More specifically, the same processing is executed to each of the different colors of Y, M, C, and K. Accordingly, in the following description, processing for the color component Y only will be described with reference to FIG. 3. In the following description, units, portions, or components similar to those described above with reference to FIG. 1 are provided with the same reference numerals and symbols. Accordingly, the detailed description thereof will not be repeated here.

Figure 3:
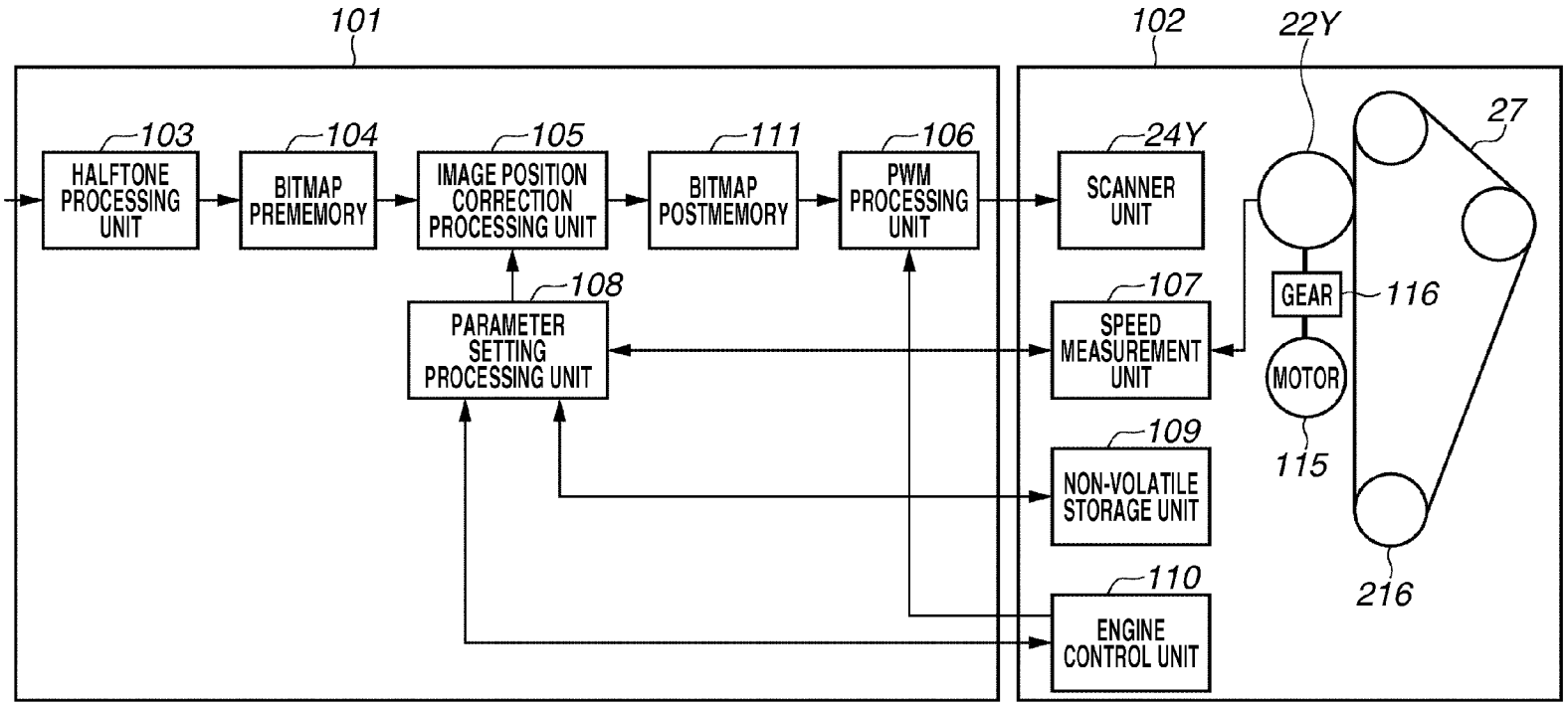
FIG. 3 illustrates exemplary functional blocks of the image forming apparatus.

Referring to FIG. 3, an image forming apparatus 101 includes the following processing units, each of which being constituted by an application specific integrated circuit (ASIC), a CPU, or a combination thereof.

The image forming apparatus 101 includes a laser printer engine 102. Image data is serially input from an external apparatus (not illustrated), such as a computer apparatus, a controller, or a document reading apparatus, to a halftone processing unit 103 in order of rasterization. More specifically, in the present exemplary embodiment, image data corresponding to the color Y, of the CMYK color space represented in the unit of 8 bits, is input. The actual image processing is executed based on the above-described image data.

The halftone processing unit 103 generates gray-scale image data by using a publicly known pseudo gray-scale representation method, such as multivalued dithering. The halftone processing unit 103 outputs the generated image data to a bitmap prememory 104. The bitmap prememory 104 includes a page memory that temporarily stores raster image data that has been subjected to halftone processing and stores image data of one page. Alternatively, any band memory capable of storing data of a plurality of lines can be also used as the bitmap prememory 104. For easier understanding, in the present exemplary embodiment, it is supposed that the bitmap prememory 104 has a capacity large enough for storing image data of one page.

An image position correction processing unit 105 executes image position correction processing, which will be described below. In addition, the image position correction processing unit 105 serially outputs the corrected image data to a bitmap postmemory 111 in order of rasterization thereof. The bitmap postmemory 111 includes a page memory for temporarily storing the raster image data that has been subjected to the image position correction processing and for image data of one page. Similarly to the bitmap prememory 104, any band memory that stores data of a plurality of lines can be used as the bitmap postmemory 111.

For easier understanding, in the present exemplary embodiment, it is supposed that the bitmap postmemory 111 has a capacity large enough to store image data of one page.

A pulse width modulation (PWM) processing unit 106 reads the image data from the bitmap postmemory 111. In addition, the PWM processing unit 106 generates a signal for driving the scanner unit 24Y.

The image forming apparatus 101, which executes exposure scanning (scanning by laser beam) by using the scanner unit 24Y, is capable of controlling the exposure amount based on a publicly known PWM signal. The scanner unit 24Y emits light from a laser diode and exposes the surface of the photosensitive member 22Y to form an electrostatic latent image.

A speed measurement unit 107 detects the rotation speed of the photosensitive member 22Y. In addition, the speed measurement unit 107 outputs the detected rotation speed to a parameter setting processing unit 108 where necessary. A nonvolatile storage unit 109 is constituted by a rewritable non-volatile memory, such as a flash memory. The nonvolatile storage unit 109 stores an apparatus body parameter, which is necessary for executing processing in the flowchart of FIG. 4. The nonvolatile storage unit 109 notifies the apparatus body parameter to the parameter setting processing unit 108.

The apparatus body parameter is a phase difference Δt between a surface speed of the photosensitive member 22Y when the scanner unit 24Y irradiates the photosensitive member 22Y with the laser beam and a surface speed of the photosensitive member 22Y when the toner image formed by the laser beam onto the photosensitive member 22Y is primarily transferred onto the intermediate transfer member 27. The phase difference Δt will be described below. The laser beam is not directly emitted from the scanner unit 24Y onto the photosensitive member 22Y. In other words, the photosensitive member 22Y is irradiated with the laser beam indirectly via various lenses or reflection mirrors.

An engine control unit 110 controls an operation of each component related to the image forming described above with reference to FIG. 1. More specifically, the engine control unit 110 controls various devices provided within the engine 102, such as the paper feed unit 21, the drive motor 115, the injection charging device 23Y, the development device 26Y, the intermediate transfer member 27, the transfer roller 28, the fixing unit 210, and the scanner unit 24Y.

In addition, the engine control unit 110 notifies exposure executable time tp to the parameter setting processing unit 108. More specifically, the engine control unit 110 notifies the exposure executable time tp for each page to the parameter setting processing unit 108. When the exposure executable time tp comes, the engine control unit 110 transmits an exposure start signal to the PWM processing unit 106.

The engine control unit 110 outputs the exposure executable time tp after each unit included in the laser printer engine 102 has become ready for image forming and the exposure scanning has become available after image data of a page to be exposed is input to the bitmap postmemory 111.

Figure 4:
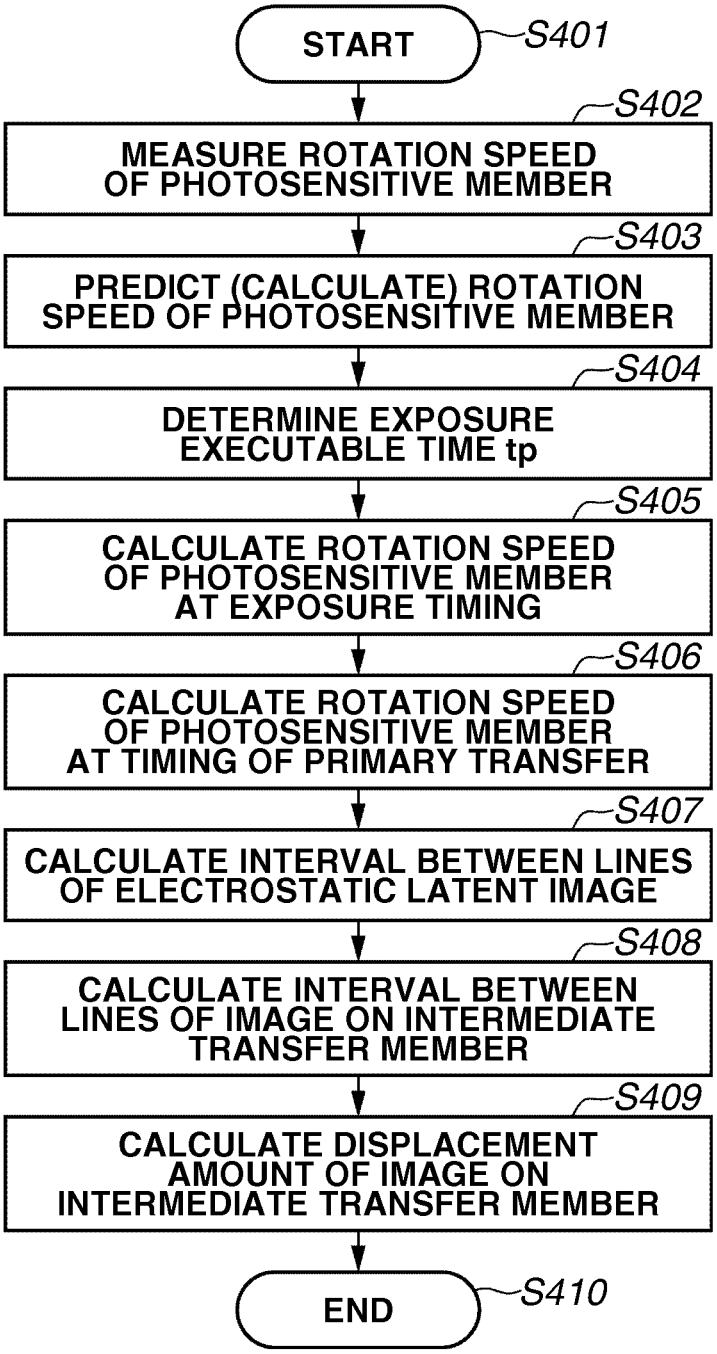
FIG. 4 is a flow chart illustrating exemplary image position correction parameter determination processing.
Figure 9:
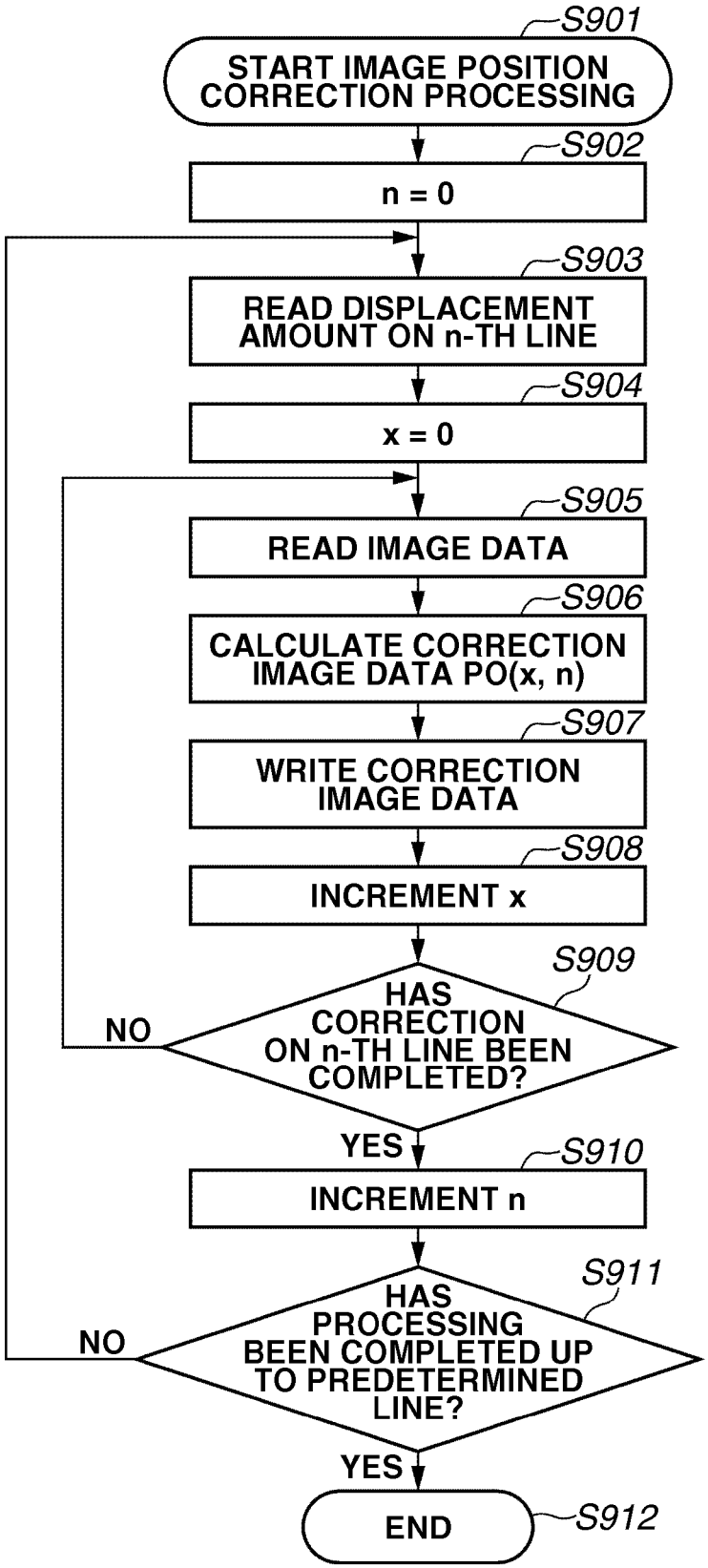
FIG. 9 is a flow chart illustrating an example of image position correction processing.

If a calculation for each line image, which will be described in detail below with reference to FIGS. 4 and 9, is completed sufficiently faster than the speed of exposure of each line image, image data of only a specific number of lines can be input to the bitmap postmemory 111 before the notification of the exposure executable time tp.

The exposure executable time tp is a timing for permitting the exposure in synchronization with the position of a printable region in a conveyance path. More specifically, if the scanning with the laser beam emitted by the scanner unit 24Y is to be executed on all printable regions, the exposure executable time tp is equivalent to a timing of first scanning by the scanner unit 24Y with the laser beam.

Accordingly, if image data corresponding to an edge of a printable region is not to be subjected to the scanning with the laser beam in an actual operation, the exposure by the scanner unit 24Y is not to be executed at the exposure executable time tp. Furthermore, in the present exemplary embodiment, the exposure executable time tp is also referred to as a "laser beam emission executable timing", which is a timing at which the emission of light (irradiation on the photosensitive member 22Y with light) by the scanner unit 24Y can be executed.

FIG. 4 is a flowchart illustrating exemplary image position correction parameter determination processing according to the present exemplary embodiment. The image position correction parameter determination processing will be described in detail below with reference to the flowchart of FIG. 4.

The flowchart of FIG. 4 illustrates processing for calculating the amount of displacement of each line image, which is primarily transferred onto the intermediate transfer member 27, from an ideal position in the sub scanning direction in relation to the variable rotation speed of the photosensitive member. Image processing (image position correction) illustrated in the flowchart of FIG. 9, which will be explained below, is executed according to a parameter of the displacement amount of each line image calculated by the processing illustrated in the flowchart of FIG. 4.

Referring to FIG. 4, in step S401, the parameter setting processing unit 108 starts image position correction parameter determination processing. In step S402, the speed measurement unit 107 measures the rotation speed of the photosensitive member 22Y. More specifically, the speed measurement unit 107 measures the rotation speed, which can sequentially vary.

For the speed measurement unit 107, a publicly known rotary encoder, which is attached to the rotation shaft of the photosensitive member 22Y, can be applied. Now, an exemplary method for measuring the rotation speed of the photosensitive member 22Y executed by the speed measurement unit 107, which is a rotary encoder, will be described below.

Figure 5A:
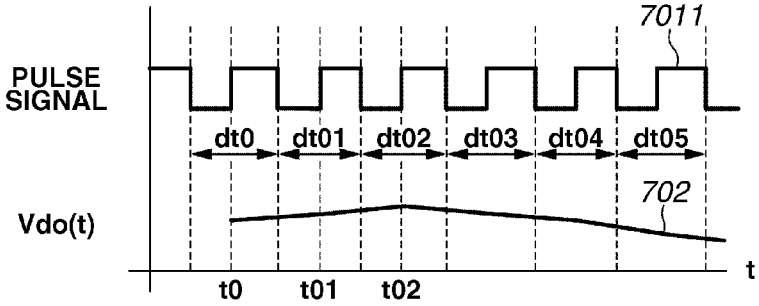
FIG. 5A is a timing chart of a signal output from a rotary encoder.

Referring to FIG. 5A, an encoder pulse signal 7011 is output from the rotary encoder. An encoder pulse signal is used for detecting the rotation speed of a rotational member to be measured. The rotary encoder outputs a square wave of 1 pulse as the rotational member rotates by a predetermined phase. More specifically, if a rotary encoder which outputs a square wave of p pulses for one rotation of the rotational member is used, the rotary encoder outputs a square wave of 1 pulse as the rotational member rotates by the cycle of 1/p.

In the following description, it is supposed that the surface speed Vdo(t) 702 of the photosensitive member 22Y from a timing t0 is measured. In this case, the speed measurement unit 107 measures time dt0 required for 1 pulse of the encoder pulse signal 7011, which has been output at the timing t0.

Subsequently, by using the following mathematical expression (1), the speed measurement unit 107 calculates the surface speed Vdo(t0) of the photosensitive member 22Y at the moment at which the required time dt0 is measured. The surface speed Vdo(t0) in the following mathematical expression (1) is superposed with a plurality of frequency components.

$$Vdo(t0)=(\pi\times R)/(p\times dt0) \quad (1)$$

where "R" denotes a diameter of the photosensitive member 22Y. For example, if the required time dt0 is measured in the unit of a second, Vdo(t0) is equivalent to the surface speed of the photosensitive member 22Y per one second.

In addition, similarly to the calculation of the required time dt0, the speed measurement unit 107 sequentially calculates times dt01, dt02, dt03, dt04, dt05 and the like required for 1 pulse. Furthermore, by executing the calculation similar to that by the mathematical expression (1), the speed measurement unit 107 measures the rotational member surface speed Vdo(t).

Figure 5B:
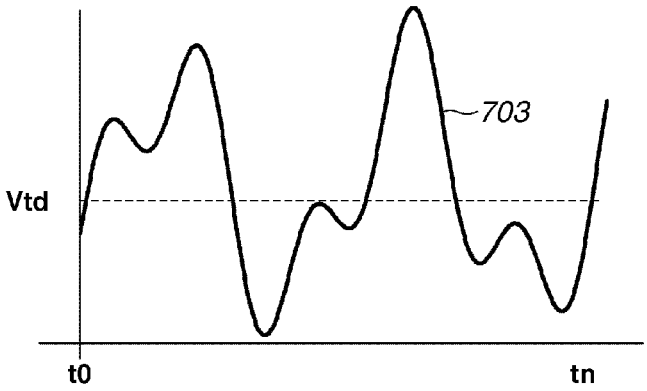
FIG. 5B illustrates an example of a variation of a photosensitive member surface speed with time.

FIG. 5B illustrates an example of a surface speed Vdo(t) 703, which is the surface speed of the photosensitive member 22Y during a time period from a timing t0 to a timing tn. Referring to FIG. 5B, the rotation speed of the photosensitive member 22Y shows fluctuation from a target surface speed Vtd.

A waveform includes cyclic speed variations (various speed components) combined therein.

The unevenness of the rotation speed, i.e., the surface speed, (the variation of speed) of the photosensitive member 22Y may be caused primarily due to unevenness of the rotation speed of the photosensitive member 22Y of the rotation cycle Td per one rotation of the photosensitive member 22Y, or due to unevenness of the rotation speed of the motor 115, which drives the photosensitive member 22Y, of the rotation cycle Tm per one rotation of the motor 115.

In some cases, the uneven speed may be caused due to decentration of a gear 116, which transmits the rotational force from the motor 115. In the following description, focusing on the rotation cycle Td per one rotation of the photosensitive member 22Y and the rotation cycle Tm per one rotation of the motor 115, a method for suppressing density unevenness that may be caused due to Td and Tm will be described.

Density unevenness that may occur due to any cause other than the uneven speed, which is caused due to the decentration of the gear 116, can also be suppressed by a method similar to the method described in the present exemplary embodiment.

In step S403, the parameter setting processing unit 108 acquires variable speed information, which includes a measurement result, from the speed measurement unit 107. Furthermore, the parameter setting processing unit 108 executes a calculation for predicting the rotation speed of the photosensitive member 22Y at an arbitrary subsequent timing based on the surface speed Vdo(t) of the photosensitive member 22Y.

In the present exemplary embodiment, the speed information refers to information about the rotation speed of the rotational member, whose rotation speed is to be measured. However, alternatively, various information other than the rotation speed can be used as the speed information. More specifically, because the variation of the speed of a rotational member corresponds to the phase of the variation of the speed of the rotational member, the phase of the variation of the speed of the rotational member can be used as the speed information. In addition, because the speed of a rotational member may constantly vary in response to the position of rotation of the rotational member, positional information about the rotational member, which indirectly indicates the rotation speed of the rotational member, can be used as the speed information.

The parameter setting processing unit 108 extracts speed unevenness Vdf(t) of the rotation cycle Td per one rotation of the photosensitive member 22Y based on the surface speed Vdo(t) of the photosensitive member 22Y. Furthermore, the parameter setting processing unit 108 calculates an amplitude Ad of the speed unevenness Vdf(t) and an initial phase ϕdt0 of the speed unevenness at a timing t0. The speed unevenness amplitude Ad and the initial phase ϕdt0 can be calculated by executing, for example, a well-known fast Fourier transform (FFT) calculation on the surface speed Vdo(t) of the photosensitive member 22Y.

Figure 5C:
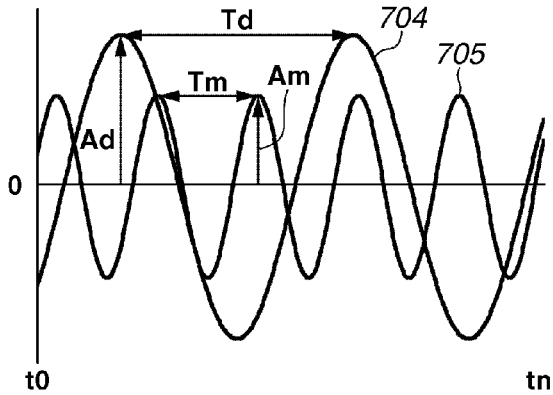
FIG. 5C illustrates an example of a variation of the photosensitive member surface speed with time for each rotation cycle.

In FIG. 5C, an example of a variable speed Vdf(t) 704, which has been extracted by the parameter setting processing unit 108, is illustrated. In the similar manner, the parameter setting processing unit 108 extracts a speed unevenness Vmf (t) of the rotation cycle Tm per one rotation of the motor 115. Furthermore, the parameter setting processing unit 108 calculates the an amplitude Am of the speed unevenness Vmf(t) and an initial phase ϕmt0 of the speed unevenness at a timing t0. In FIG. 5C, an example of a variable speed Vmf(t) 705, which has been extracted by the parameter setting processing unit 108, is illustrated.

By using the following mathematical expression (2), the speed Vd(t) of the photosensitive member 22Y at an arbitrary time t, which is calculated based on the cycles Td and Tm, can be calculated:

$$Vd(t)=Vtd+Ad\times\cos(\omega d\times t-\phi dt0)+Am\times\cos(\omega m\times t-\phi mt0) \quad (2)$$

where each of terms ωd and ωm can be calculated as follows:

$$\omega d=2\pi/Td$$

$$\omega m=2\pi/Tm.$$

In the mathematical expression (2), the term Vd(t) expresses that the uneven rotation speed of the rotation cycle Td per one rotation of the photosensitive member 22Y and the uneven rotation speed of the rotation cycle Tm per one rotation of the motor 115 are superposed with regard to the target surface speed Vtd.

Figure 6:
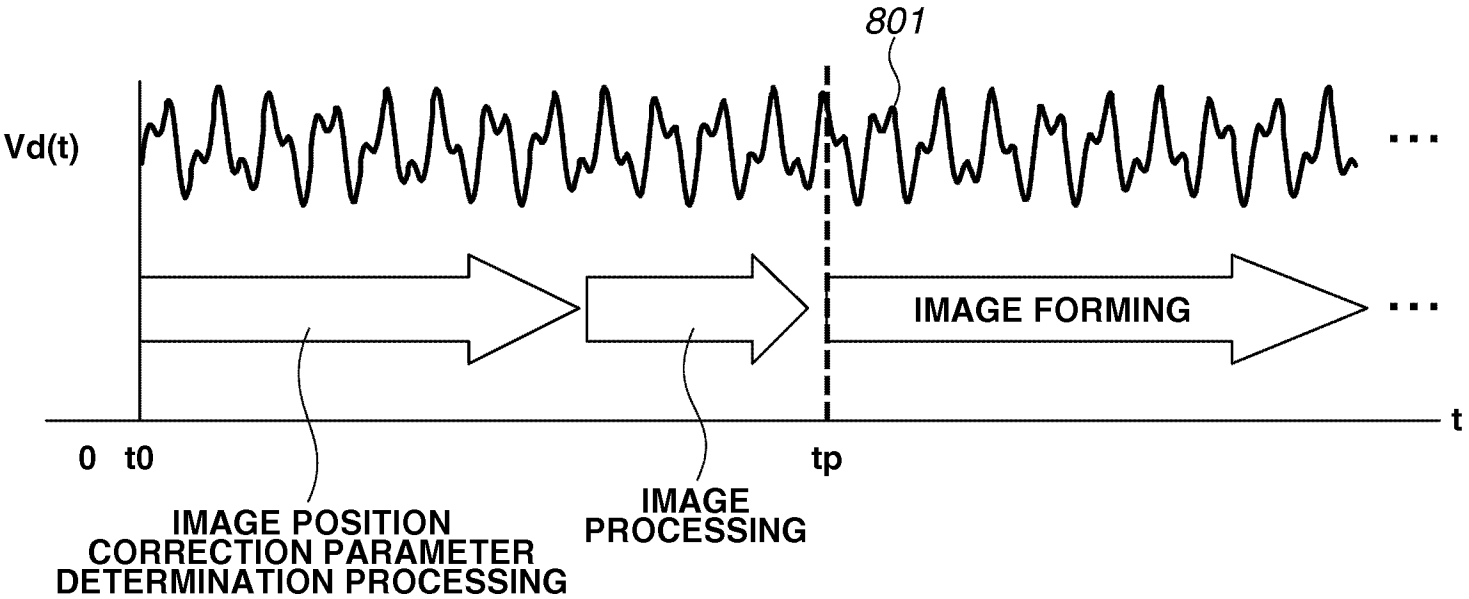
FIG. 6 illustrates a correspondence relation between a variation with time of the surface speed of a photosensitive member and a processing content.

When the cycles Td and Tm are focused, which are calculated by the calculation, the speed Vd(t) of the photosensitive member 22Y at an arbitrary time t is equivalent to a speed 801 illustrated in FIG. 6. The parameter setting processing unit 108 executes the calculation for the speed Vd(t) for all pages of the print job.

FIG. 6 illustrates what processing is to be executed according to the variation of the speed Vd(t) of the photosensitive member 22Y in response to the variation with time. The image position correction parameter determination processing and the image processing for a second page and thereafter are executed in parallel to the image forming of a first page. More specifically, FIG. 6 schematically illustrates an exemplary order of the processing. As illustrated in FIG. 6, the time taken for actual image forming is longer than the total of time required for two types of the processing executed previous thereto. The time t in FIG. 6 is timing information, which can be represented by a timer count value.

In step S404, the engine control unit 110 determines the exposure executable time tp. The determined exposure executable time tp is notified to the parameter setting processing unit 108. In addition, the engine control unit 110 determines the exposure executable time tp for each page. The determined exposure executable time tp for each page is notified to the parameter setting processing unit 108.

The exposure executable time tp can be defined as time of the following timing. The exposure executable time tp is a time at which the exposure of an image can be predicted to be executed after each component of the laser printer engine 102 has become ready for image forming, the processing in the flowchart of FIGS. 4 and 9 have been completed, and image data of the image has been input to the bitmap postmemory 111.

If a calculation for each line image, which will be described in detail below with reference to FIGS. 4 and 9, is completed sufficiently faster than the speed of exposure of each line image, image data of only a specific number of lines can be input to the bitmap postmemory 111 before the notification of the exposure executable time tp.

In step S405, the parameter setting processing unit 108 calculates the surface speed Ve(t) of the photosensitive member 22Y during the exposure. The surface speed Vd(t) of the photosensitive member 22Y can be directly used as Ve(t). Accordingly, the surface speed Ve(t) of the photosensitive member 22Y when the exposure is executed at the time t can be expressed by the following mathematical expression (3).

$$Ve(t)=Vd(t) \quad (3).$$

Figure 7:
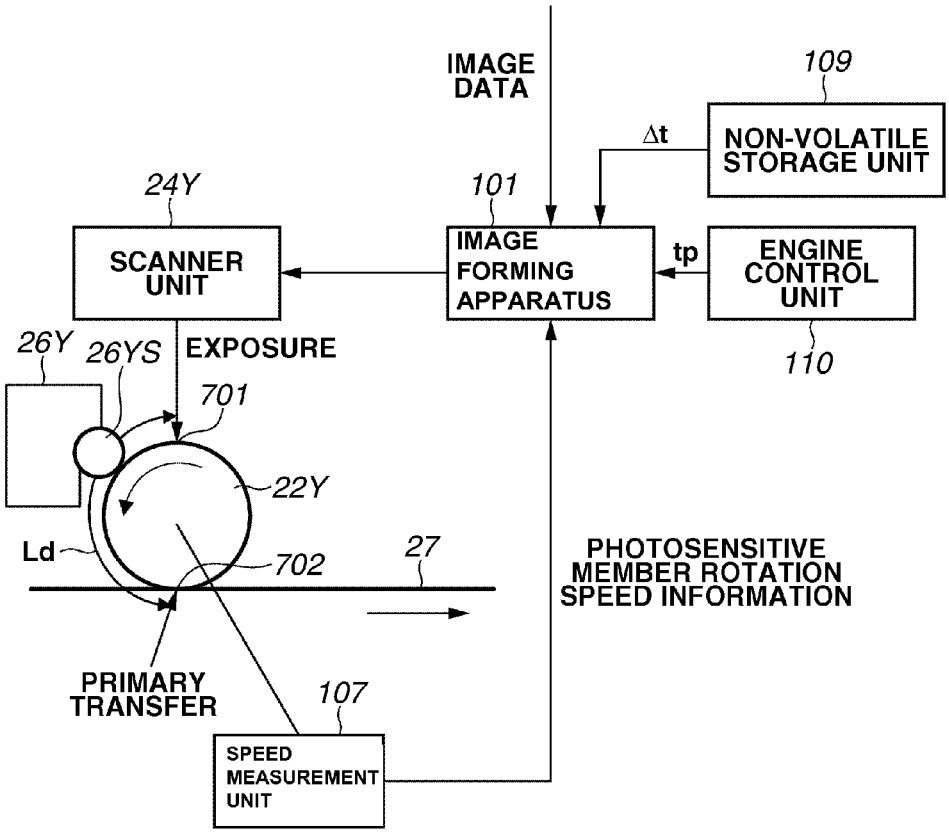
FIG. 7 illustrates an example of a series of operations from exposure processing to primary transfer processing.

In step S406, the parameter setting processing unit 108 predicts (calculates) the surface speed Vt (t) of the photosensitive member 22Y when the image exposed at the time t is primarily transferred. At the position of the latent image on the photosensitive member 22Y, which has been exposed based on image information, the latent image is developed by the development unit 26Y. Then the developed image is primarily transferred to the intermediate transfer member 27, as illustrated in FIG. 7.

The latent image exposed by the scanner unit 24Y at an exposure point 701 is conveyed to the position of the development unit 26Y. The latent image is subjected to the development by using the toner at the development unit 26Y. The developed toner image is conveyed to a primary transfer point 702. Then the toner image is primarily transferred onto the intermediate transfer member 27.

As described above, it takes a specific length of time to primarily transfer an image after exposure. Furthermore, for an image exposed at the time t, a specific phase difference Δt (time difference) may arise on the speed of the photosensitive member 22Y when the image is primarily transferred. The specific phase difference Δt is determined according to the distance, which is indicated as Ld in FIG. 7, between the exposure point 701 and the primary transfer point 702 and according to an average surface speed of the photosensitive member 22Y. The specific phase difference Δt can be expressed as follows:

$$\Delta t=2\pi\times(\mathrm{mod}(Ld/Vtd,Td))/Td.$$

The target surface speed Vtd is used for the average surface speed of the photosensitive member 22Y. The nonvolatile storage unit 109 stores the phase difference Δt. In addition, the nonvolatile storage unit 109 notifies the information expressed as the phase difference Δt to the parameter setting processing unit 108 where necessary.

Because the position of the exposure point 701 may vary due to the affect from an error of an installation position of the scanner unit 24Y, different apparatuses may have different values of the phase difference Δt. Therefore, it is necessary to measure the phase difference Δt (time difference) of each apparatus during the manufacture of the apparatus and to store the measured phase difference Δt in the nonvolatile storage unit 109.

For example, during the manufacture of an image forming apparatus, the speed measurement unit 107 is temporarily provided around the primary transfer point 702 (FIG. 7) to measure the rotation speed (the surface speed Vt(t)) of the photosensitive member 22Y at the time of image transfer. Alternatively, the rotation speed of the photosensitive member 22Y at the time of image transfer can be measured according to a result of detection by two sensors, which can be provided across the photosensitive member 22Y in the direction of rotation thereof and which has a function similar to the function of the speed measurement unit 107.

As described above, the present exemplary embodiment is intended to various methods for measuring the phase difference between the speed Vd (t) achieved when the laser beam is emitted from the scanner unit 24Y and the rotation speed of the photosensitive member 22Y achieved when the toner image developed is transferred during the manufacture of the apparatus.

With the notified phase difference Δt, the parameter setting processing unit 108 calculates the surface speed Vt(t) of the photosensitive member 22Y when the image exposed at the time t is primarily transferred, by using the following mathematical expression (4). As expressed by the mathematical expression (4), the phase difference may arise for each cycle of the speed unevenness.

$$Vt(t)=Vtd+Ad\times\cos(\omega d\times t-\phi dt0+\Delta td)+Am\times\cos(\omega m\times t-\phi mt0\times\Delta tm) \quad (4)$$

where "Δtd" denotes the phase difference of the speed unevenness of the rotation cycle Td per one rotation of the photosensitive member 22Y, "Δtm" denotes the phase difference of the speed unevenness of the rotation cycle Tm per one rotation of the motor 115, the term "phase difference Δt" collectively denotes the phase differences, and the phase difference Δt={Δtd, Δtm}.

In step S407, the parameter setting processing unit 108 calculates the interval between the lines of the electrostatic latent image.

The scanner unit 24Y executes exposure scanning by a specific scanning interval ts to form an electrostatic latent image by a specific target line interval W when the photosensitive member 22Y rotates by the target surface speed Vtd. In particular, if the conveyance speed Vb of the intermediate transfer member 27 is the same as the target surface speed Vtd of the photosensitive member 22Y, the target line interval W can be set as the interval between lines of the electrostatic latent image formed on the photosensitive member 22Y. For easier understanding, in the present exemplary embodiment, it is supposed that the following mathematical expression (5) applies:

$$Vb=Vtd \quad (5).$$

The specific scan interval ts can be calculated by the following mathematical expressions (6) and (7):

$$ts\times Vtd=W \quad (6)$$

$$ts=W/Vtd \quad (7).$$

Figure 8A:
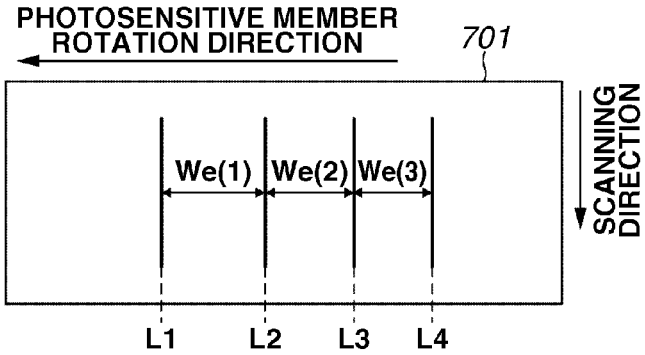
FIGS. 8A through 8D illustrate a deviation of an interval between line images from an ideal interval after the primary transfer.

FIG. 8A illustrates an example of a formation of an electrostatic latent image at the exposure point 701, viewed from the scanner unit 24Y side (the upper side). In the example illustrated in FIG. 8A, an electrostatic latent image L1 is formed at the exposure executable time tp. In addition, an electrostatic latent image L2, an electrostatic latent image L3, and an electrostatic latent image L4 are formed at time (tp+ts), time (tp+2ts), and time (tp+3ts), respectively.

In this state, an interval We(1) between the electrostatic latent images L1 and L2, an interval We(2) between the electrostatic latent images L2 and L3, an interval We(3) between the electrostatic latent images L3 and L4 and an interval We(n) between the electrostatic latent images Ln and L(n+1) can be described as follows.

The electrostatic latent image L1 is formed at the time tp, and the electrostatic latent image L2 is formed at time (tp+ts). Accordingly, the interval We(1) between the time tp and the time (tp+ts) corresponds to the distance of the displacement of the surface of the photosensitive member 22Y during a time period from the time tp to the time (tp+ts). Therefore, the interval We(1) can be acquired by calculating a definite integral of the surface speed Ve(t) of the photosensitive member 22Y during the time period from the time tp to the time (tp+ts).

Because the scan interval ts is short enough, the speed of the photosensitive member 22Y from the time tp to the time (tp+ts) can be approximated by the surface speed Ve (tp) of the photosensitive member 22Y. Therefore, the line interval We(n) of the electrostatic latent image can be calculated by multiplying the approximated speed Ve (t) of the photosensitive member 22Y with the scan interval ts by using the following mathematical expressions (8).

The parameter setting processing unit 108 calculates the line interval We(n) by using the mathematical expression (8) for each of the lines of an electrostatic latent image existing in the page to be processed. In addition, the parameter setting processing unit 108 calculates the line interval We(n) for the exposure executable time tp for each page. As a result, a displacement amount E(n) is calculated based on the line interval We(n). More specifically, the displacement amount E(n) is calculated based on the level of the phase (the state of the speed) of Ve at the exposure executable time tp.

$$We(1) \approx Ve(tp) \times ts$$

$$We(2) \approx Ve(tp+ts) \times ts$$

$$We(n) \approx Ve(tp+(n-1)ts) \times ts \quad (8).$$

In step S408, the parameter setting processing unit 108 calculates the line interval of the image that has been primarily transferred on the intermediate transfer member 27. As described above, the electrostatic latent image is developed by the development unit 26Y and the developed image is conveyed to the primary transfer point 702. The image is primarily transferred on the intermediate transfer member 27 at the primary transfer point 702.

Figure 8B:
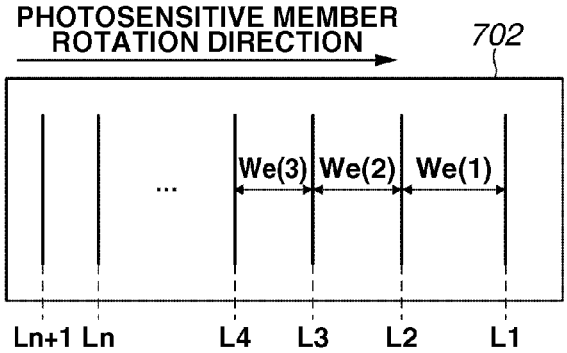

FIG. 8B illustrates the image that has been exposed by the processing illustrated in FIG. 8A and having been conveyed to the primary transfer point 702, viewed from the scanner unit 24Y (i.e., viewed from above). In the example illustrated in FIG. 8B, the same image as that illustrated in FIG. 8A is provided with the same reference symbol and numeral. In the example illustrated in FIG. 8B, each interval between the lines is the same as the line interval of the electrostatic latent image, which has been calculated in step S407.

An interval Wt(1) (FIG. 8C), which is an interval between the primarily transferred images L1 and L2, can be acquired based on the distance of travel of the intermediate transfer member 27 during time from the timing of the primary transfer of the image L1 to the timing of the primary transfer of the electrostatic latent image L2, which is distant from the electrostatic latent image L1 by the distance We(1).

The time from the timing of the primary transfer of the electrostatic latent image L1 to the timing of the primary transfer of the electrostatic latent image L2, which is distant from the electrostatic latent image L1 by the distance We(1), can be acquired, by using the surface speed Vt(t) of the photosensitive drum 22Y and the distance We(1), by calculating a value of time x, with which the definite integral of time from the time tp of the surface speed Vt(t) of photosensitive drum 22Y to time (tp+x) becomes the distance We(1). However, because the time x is short enough, the speed of the photosensitive member 22Y during the time from the time tp to the time (tp+x) can be approximated by Vt(tp).

Accordingly, in the following manner, the parameter setting processing unit 108 calculates the interval Wt(1) between the electrostatic latent images L1 and L2, which have been primarily transferred, by multiplying the time required for the primary transfer over the distance We(1) with the conveyance speed Vb of the intermediate transfer member 27. In the similar manner, the intervals Wt(2) and Wt(n) can be calculated.

The parameter setting processing unit 108 calculates the interval Wt(n) for each line image in the page to be processed by using the following mathematical expression (9). In addition, the parameter setting processing unit 108 calculates the interval Wt(n) at the exposure executable time tp for each page.

$$Wt(1) \approx \{We(1)/Vt(tp)\} \times Vb$$

$$Wt(2) \approx We\{(2)/Vt(tp+ts)\} \times Vb$$

$$Wt(n) \approx We(n)/\{Vt(tp+(n-1)ts)\} \times Vb \quad (9)$$

where "Vp" denotes the conveyance speed of the intermediate transfer member 27 as described above.

Figure 8C:
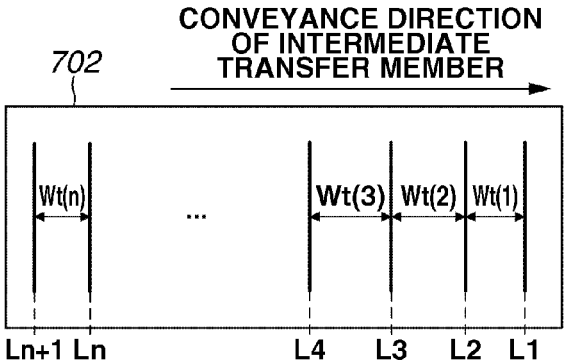

FIG. 8C illustrates an example of the image primarily transferred on the intermediate transfer member 27. In the example illustrated in FIG. 8C, the same image as the image illustrated in FIGS. 8A and 8B is provided with the same reference numeral and symbol.

As described above, the line intervals of the image on the intermediate transfer member 27 may become uneven due to the uneven speed of the photosensitive member 22Y. Due to the unevenness of the line intervals, density unevenness may occur on the image.

Figure 8D:
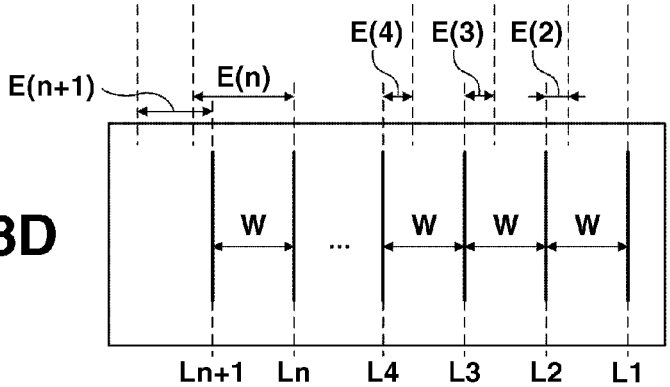

FIG. 8D illustrates an example of an image in an ideal state, in which the line intervals are even. In the example illustrated in FIG. 8D, the same image as the image illustrated in FIGS. 8A through 8C is provided with the same reference numeral and symbol.

As illustrated in FIG. 8D as the electrostatic latent image L1, the image has been primarily transferred at the same position as the position of the electrostatic latent image L1 illustrated in FIG. 8C. The subsequent images have been primarily transferred with a specific distance (interval) W. If each line interval is equivalent to the specific distance W as illustrated in FIG. 8D, unevenness of line intervals can be solved. Accordingly, in this case, no density unevenness may occur.

To suppress density unevenness, the present exemplary embodiment corrects the position of the image, which is to be primarily transferred as illustrated in FIG. 8C, to be actually primarily transferred with a specific constant interval as illustrated in FIG. 8D.

In step S409, the parameter setting processing unit 108 calculates the amount of displacement of the image that has been primarily transferred on the intermediate transfer member 27 from the ideal state. More specifically, because the electrostatic latent image L1 is primarily transferred at the same position as the position illustrated in FIG. 8D, the displacement amount E(1)=0.

The displacement amounts E(2), E(3), E(4) and E(n) of the electrostatic latent images L2 and L3 and an arbitrary image Ln, respectively, can be calculated by using each of the following corresponding mathematical expressions. More specifically, the parameter setting processing unit 108 calculates the displacement amount E(n) for each interval Wt(t) between images included in the page to be processed by using the following mathematical expression (10). In addition, the parameter setting processing unit 108 calculates the displacement amount E(n) at the exposure executable time tp for each page.

$$E(2) = W - Wt(1)$$

$$E(3) = 2W - \{Wt(1) + Wt(2)\}$$

$$= E(2) + \{W - Wt(2)\}$$

$$E(n) = E(n-1) + \{W - Wt(n-1)\} \quad (10).$$

As described above, the parameter setting processing unit 108 uses the mathematical expression (10) to calculate the amount of displacement from the ideal position of the image based on the surface speed Vd of the photosensitive member 22Y when the laser beam is emitted from the scanner unit 24Y and based on the rotation speed Vt of the photosensitive member 22Y when the toner image developed by the laser beam emitted by the scanner unit 24Y is transferred on the member to be transferred.

As expressed by the mathematical expression (4), in calculating the rotation speed Vt of the photosensitive member 22Y, the phase difference Δt is used as the term of the mathematical expression (4). If the displacement amount E(n) has a positive value, it is expressed that the image is displaced from the ideal state (position) in the conveyance direction of the intermediate transfer member 27. On the other hand, if the displacement amount E(n) has a negative value, it is expressed that the image is displaced from the ideal state in the reverse direction of the conveyance direction of the intermediate transfer member 27.

The values of the intervals (distances) Wt(1) and Wt(2) may vary according to the level of the phase to which the speed Vd(t) corresponds at the exposure executable time tp. According to the present exemplary embodiment, the parameter setting processing unit 108 is capable of calculating precise displacement amounts of the intervals Wt(1) and Wt(2) regardless of the values of thereof by using the mathematical expression (10). After calculating the displacement amount E(n) by using the mathematical expression (10), the information about the displacement amount E(n) is stored in a storage unit (not illustrated). The stored displacement amount E(n) is read by the image position correction processing unit 105 in later processing.

After executing the above-described processing, the processing advances to step S410. In step S410, the image position correction parameter determination processing ends.

Now, exemplary image position correction processing will be described in detail below with reference to FIG. 9. Processing described below with reference to the flowchart of FIG. 9 is executed by the image position correction processing unit 105 on the image position correction parameter (i.e., the parameter of the amount of displacement of each line image) for each page, which has been calculated by the parameter setting processing unit 108 during the processing described above with reference to the flowchart of FIG. 4.

Referring to FIG. 9, in step S901, the image position correction processing unit 105 starts the image position correction processing for correcting the image position. In step S902, the image position correction processing unit 105 initializes a value of a counter n, which counts the currently processed line, with a value "0".

In step S903, the image position correction processing unit 105 reads the image displacement amount E(n) on an n-th line from the storage unit (not illustrated) included in the parameter setting processing unit 108. Furthermore, the image position correction processing unit 105 corrects the displacement of the image by moving the image of the n-th line by −E(n).

Figures 10A, 10B, 10C:
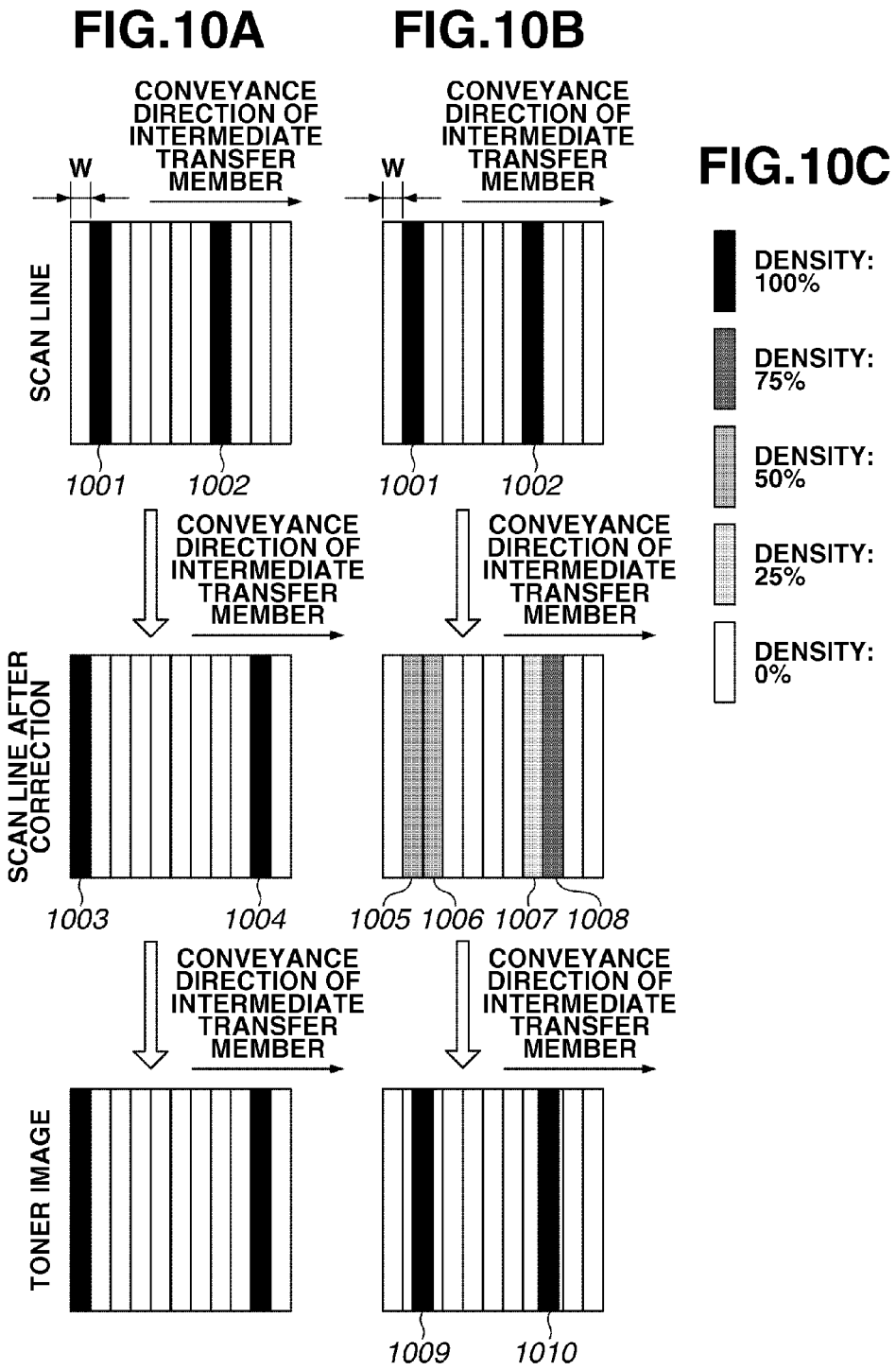
FIGS. 10A through 10C illustrate a method for correcting the position of an image by image processing.

Now, exemplary processing for correcting the image position will be described in detail below with reference to FIGS. 10A through 10C. FIG. 10A illustrates an exemplary method for correcting the image position in the unit of a line. In the example illustrated in FIG. 10A, a line 1001 is positionally corrected by −W while a line 1002 is positionally corrected by 2 W.

Furthermore, the line 1001 is moved by one line to a line 1003 in a direction reverse to the intermediate transfer member conveyance direction. Moreover, the line 1002 is moved by two lines to a line 1004 in the intermediate transfer member conveyance direction. In this manner, the image position correction processing unit 105 corrects the image displacement.

FIG. 10B illustrates an exemplary method for correcting image displacement by moving an image by less than one line. In the example illustrated in FIG. 10B, the line 1001 is positionally corrected by 0.5 W while the line 1002 is positionally corrected by 0.75 W.

In this case, as illustrated with lines 1005 and 1006, 50% of the density of each pixel constituting the line 1001 is assigned to the line 1005 while the other 50% is assigned to the line 1006. In addition, as illustrated with lines 1007 and 1008, 25% of the density of each pixel constituting the line 1002 is assigned to the line 1007 while the other 75% is assigned to the line 1008.

By exposing the image in this state, the toner image is formed at the position according to the density ratio as illustrated with lines 1009 and 1010. The line image 1009 can be positionally corrected by 0.5 W while the line image 1010 can be positionally corrected by 0.75 W.

A correction target pixel density value Po(x, n) can be calculated by the following mathematical expression (11) where "Pi(x, n)" denotes a pixel density value of an x-th pixel on the n-th line in the main scanning direction. In the mathematical expression (11), the term in which "lt" is added to the term "n" of Pi(x, n) corresponds to the correction of image displacement executed in the unit of a line image.

$$lt=\mathrm{floor}(-E(n)/W)$$

$$\alpha=(-E(n)/W)-lt$$

$$\beta=1-\alpha$$

$$Po(x,n+lt)=Pi(x,n)\times\beta$$

$$Po(x,n+lt+1)=Pi(x,n)\times\alpha \qquad (11)$$

where "×β" and "×α" correspond to image processing for displacing the barycenter of the image, which is processing for correcting image displacement by moving the image by less than one line, and "floor(x)" denotes discarding of all digits to the right of the decimal point.

More specifically, if (−E(n)/W)=1.6, Po and Pi can be calculated in the following manner. To paraphrase this, because lt=1, α=0.6, and β=0.4, therefore Po(x, n+1)=Pi(x, n)×0.4) and Po(x, n+2)=Pi (x, n)×0.6).

The above-described expression expresses that the exposed toner image can be formed at a position after displacement by 1.6 lines (i.e., by 1.6 W) by assigning 60% of the input image density value to a position to which the image is displaced by two lines in the intermediate transfer member conveyance direction and by assigning 40% of the input image density value to a position to which the image is displaced by one line in the intermediate transfer member conveyance direction.

In step S904, the image position correction processing unit 105 initializes the counter x with "0". In step S905, the image position correction processing unit 105 reads the image density value Pi (x, n) from the bitmap prememory 104.

In step S906, the image position correction processing unit 105 calculates correction image data Po by using the following mathematical expression (18). In step S907, the image position correction processing unit 105 writes the calculated correction image data onto the bitmap postmemory 111.

In the present exemplary embodiment, the position of the image data to be stored is changed according to a term lt of the following mathematical expression (19). Furthermore, the image density value to be stored is corrected according to terms "α" and "β".

In step S908, the image position correction processing unit 105 increments the counter x. In step S909, the image position correction processing unit 105 determines whether the correction on the n-th line has been completed. If it is determined that the correction on the n-th line has not been completed yet (No in step S909), then the processing returns to step S905 and repeats the processing in step S905 and beyond.

On the other hand, if it is determined that the correction on the n-th line has been completed (Yes in step S909), then the processing advances to step S910. In step S910, the image position correction processing unit 105 increments the counter n. In step S911, the image position correction processing unit 105 determines whether the processing up to a predetermined line has been completed.

If it is determined that the processing up to a predetermined line has not been completed yet (No in step S911), then the processing returns to step S903 and repeats the processing in step S903 and beyond. On the other hand, if it is determined that the processing up to a predetermined line has been completed (Yes in step S911), then the image position correction processing ends in step S912.

Now, processing executed during image forming will be described in detail below with reference to the flowchart of FIG. 11. The processing in the flowchart of FIG. 11 is executed page by page.

Figure 11:
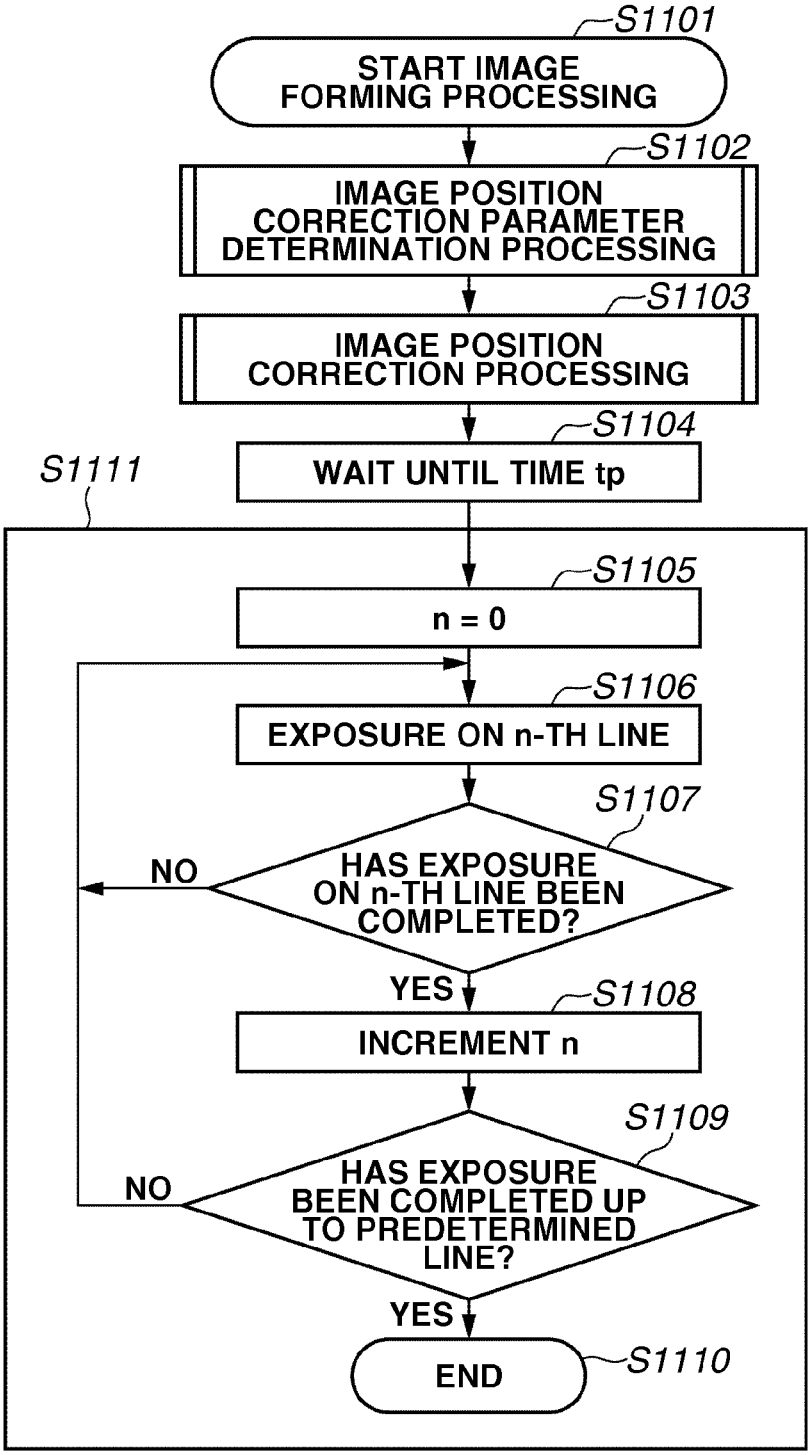
FIG. 11 is a flow chart of a series of processing executed by the image forming apparatus during image forming.

Referring to FIG. 11, in step S1101, after image data is externally input, the image forming apparatus 101 starts image forming. In step S1102, the image forming apparatus 101 executes the above-described image position correction parameter determination processing according to the flowchart of FIG. 4.

In step S1103, the image forming apparatus 101 executes the image processing for correcting image displacement described above with reference to the flowchart of FIG. 9. After the processing in step S1103 is completed, the image data, whose image displacement has been corrected, is stored in the bitmap postmemory 111. The image data is an image whose image displacement, which has occurred at the start of the exposure at the exposure executable time tp, has been corrected by the image position correction processing unit 105.

In step S1104, the bitmap postmemory 111 waits until the exposure executable time tp comes. More specifically, in step S1104, when the exposure executable time tp comes, the engine control unit 110 transmits an exposure start signal to the PWM processing unit 106. In step S1105, after receiving the exposure start signal from the engine control unit 110, the PWM processing unit 106 initializes the counter n with "0".

In step S1106, the PWM processing unit 106 executes exposure on the n-th line. More specifically, the PWM processing unit 106 reads the image data Po (x, n) of the n-th line from the bitmap postmemory 111 and drives the scanner unit 24Y.

In step S1107, the PWM processing unit 106 determines whether the exposure on the n-th line has been completed. If it is determined that the exposure on the n-th line has not been completed yet (No in step S1107), then the processing returns to step S1106 and repeats the processing in step S1106. On the other hand, if it is determined that the exposure on the n-th line has been completed (Yes in step S1107), then the processing advances to step S1108. In step S1108, the PWM processing unit 106 increments the counter n.

In step S1109, the PWM processing unit 106 determines whether the exposure has been completed up to a predetermined line. If it is determined that the exposure up to a predetermined line has not been completed yet (No in step S1109), then the processing returns to step S1106 and repeats the processing in step S1106 and beyond. On the other hand, if it is determined that the exposure has been completed up to a predetermined line (Yes in step S1109), then the processing advances to step S1110. In step S1110, the image forming for the page to be processed ends.

In the processing in the flowchart of FIG. 11, the processing in the above-described steps is sequentially executed. However, the present exemplary embodiment is not limited to this. More specifically, the processing in steps S1102 and S1103 can be executed in parallel to the processing in the other steps.

As described above, the present exemplary embodiment executes a series of calculations for Vdo(t), Vd(t), Vt(t), We(n), Wt(n), E(n), and Po(n, x) by using the mathematical expressions (1), (2), (4), (8), (9), (10), and (11), respectively. However, the above-described series of calculations may not always be required. More specifically, if Δt (Δtd and Δtm) has a predetermined value, the displacement amount E(n) can be uniquely determined for the value of Vd(t), which is calculated by using the mathematical expression (2).

To paraphrase this, it is not always required to execute the above-described series of calculations. In other words, if Δt (Δtd and Δtm) has a predefined value, a table for outputting E(n) according to an input value of Vd(t) can be provided. To specifically describe the table, with respect to the surface speed Vd(t) of the photosensitive member 22Y, the value of Vd(t0) may vary according to the rotation state (speed) of the photosensitive member 22Y and of the motor 115, with which the speed measurement unit 107 starts the measurement.

Accordingly, if the table is used, a basic table storing Vd(t) and Wt(n), which have been previously associated with each other, is stored in the nonvolatile storage unit 109. In addition, the parameter setting processing unit 108 executes the following analysis. In other words, the parameter setting processing unit 108 analyzes the matching status between Vd(t0') . . . Vd(n'), which have been measured by the speed measurement unit 107, and Vd(t), by determining to which Vd(t) stored in the basic table the value Vd(t0') . . . Vd(n') corresponds, every time the processing in step S402 is executed.

Subsequently, the parameter setting processing unit 108 inputs a Vd(t) that matches any Vd(n') to the table. In addition, the parameter setting processing unit 108 acquires Wt(n), which is output from the table, as an output for the input of Vd(n'). After Wt(n) is acquired for each Vd(t), the parameter setting processing unit 108 can execute the calculation described above by using the mathematical expression (10).

With the above-described configuration, the calculation load on the parameter setting processing unit 108 can be reduced. As described above, in the present exemplary embodiment, the correction of image displacement is executed after the halftone processing. However, the halftone processing can be executed after the image displacement is corrected.

In addition, in the present exemplary embodiment, the phase difference Δt is stored in the nonvolatile storage unit 109. However, the phase difference Δt can be calculated based on a distance Ld, which is a distance (the travel of the photosensitive member 22Y) between exposure and primary transfer timings. In this case, the distance Ld can be stored in the nonvolatile storage unit 109.

In addition, in the present exemplary embodiment, the image data that has been subjected to the halftone processing is temporarily stored in the bitmap prememory 104. However, the image data can be directly input to the image position correction processing unit 105 without using the bitmap prememory 104.

With the above-described configuration, the present exemplary embodiment can more directly solve the problem of uneven line images. Accordingly, the present exemplary embodiment having the above-described configuration can achieve an image having a higher image quality.

Now, a difference of an effect of correcting density unevenness between the case of image displacement correction and the case of density correction will be described in detail below with reference to FIG. 12.

Figure 12:
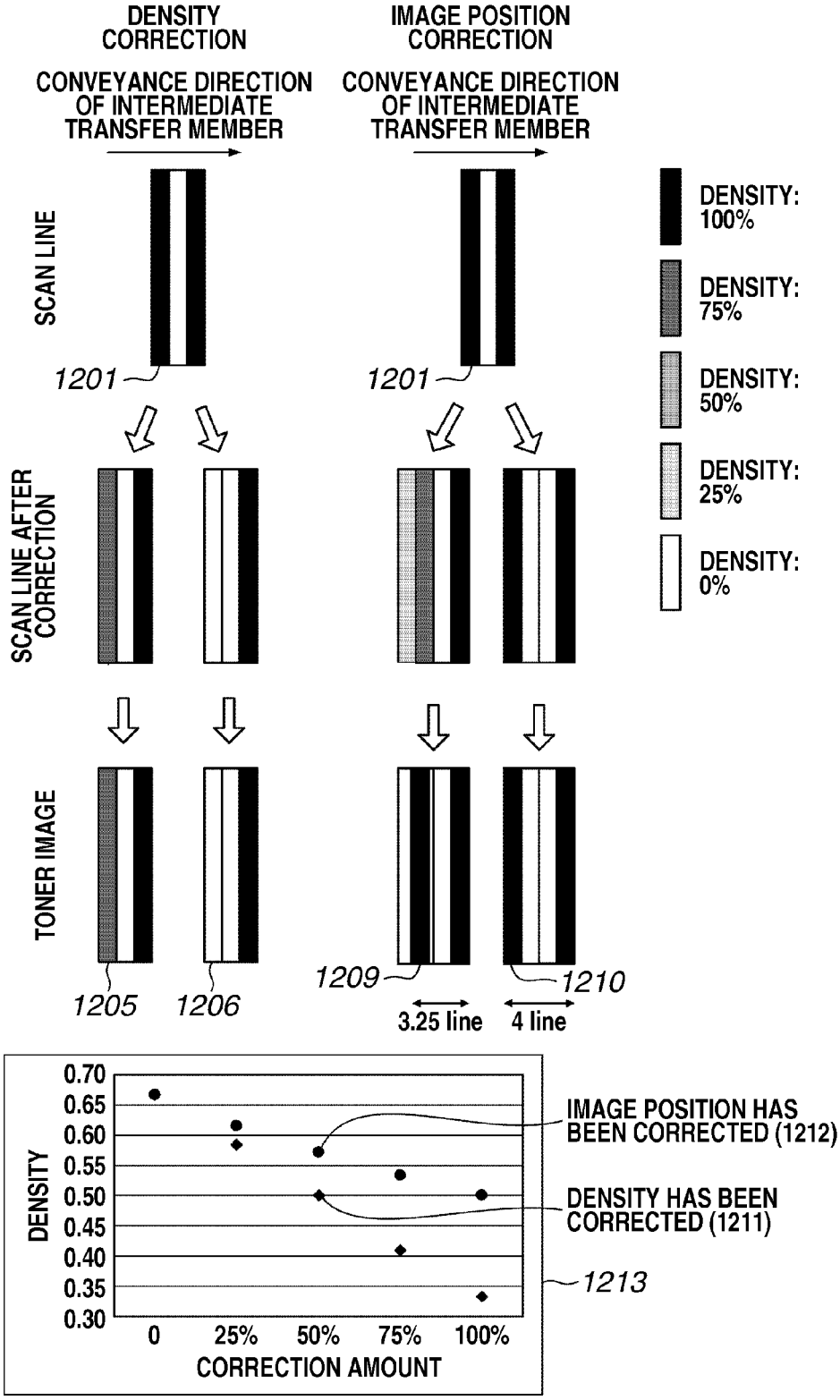
FIG. 12 illustrates an example of an effect by the image position correction processing.

Referring to FIG. 12, it is supposed that the image correction by density correction is executed by four stages (by quarters) only. In other words, the amount of exposure by PWM signal can be divided into five stages only, i.e., 0%, 25%, 50%, 75%, and 100%.

In the following description, processing for decreasing (correcting) the density of an image whose two lines on the edges among three lines have the density of 100%. Line images 1205 and 1206 are examples of an image acquired by decreasing the image density of a line 1901 (FIGS. 19A and 19B) by executing the density correction thereon.

As described above, the PWM signal can be provided for five stages only. Accordingly, the finest correction can be executed at the stage of 75%, which is acquired by decreasing the exposure amount on the line 1901 by 25% as illustrated with the line 1205 (i.e., when the density of the toner image 1205 is 75%).

To macroscopically consider the image density of an image before correction, two lines of the original image among three lines thereof have the density of 100%. Accordingly, the density is 2/3(≈0.67). In addition, for the density of the image after the correction, because one of the three lines has the density of 100% and another line has the density of 75%, the image density becomes 1.75/3≈0.58. When the correction amount is increased in the similar manner, the density levels of the line 1201 is 50%, 25%, 0%, respectively.

In the example illustrated in FIG. 12, the density of the line 1206 of the toner image is 0%. The image density in this case becomes 1/3≈0.33%. Furthermore, a point 1211 in a graph 1213 denotes the relationship between the correction amount and the image density after the density correction has been completed.

On the other hand, a line 1209 is achieved by position correction by correcting (displacing) the line 1901 in the reverse direction of the intermediate transfer member conveyance direction by 0.25 lines.

Because the levels of the PWM signal can be divided into five stages only, the finest correction can be executed at the stages of 25% or 75%, which is acquired by correcting the exposure amount on the mutually adjacent two lines by 25% and 75% (by 0.25 lines), respectively, as illustrated with the line 1209.

To macroscopically consider the image density of an image before correction, two lines of the original image among three lines thereof have the density of 100%. Accordingly, the density is 2/3 (≈0.67). In addition, for the density of the image after the correction, because two of the 3.25 lines have the density of 100%, the image density becomes 2/3.25≈0.62. When the correction amount is increased in the similar manner, the position of the line 1201 can be sequentially corrected by 0.5 lines, 0.75 lines, and 1 line. A line 1210 is a result of correcting the image by 1 line. The image density in this state is 2/4=0.5.

A point 1212 in the graph 1213 denotes the relationship between the correction amount and the image density when the image is corrected by positional correction. As illustrated with the graph 1213, if the number of stages of the exposure amount is small in particular, the correction can be more finely executed by the position correction.

In the first exemplary embodiment described above, the phase difference Δt is measured for each apparatus during manufacture of the image forming apparatus and the measured phase difference Δt is previously stored in the nonvolatile storage unit 109.

However, the first exemplary embodiment, which has the above-described configuration, cannot store a correct phase difference if the phase difference Δt has changed after the image forming apparatus is manufactured. In order to prevent this problem, a second exemplary embodiment of the present invention measures the phase difference Δt by using a sensor provided within the apparatus. Accordingly, the present exemplary embodiment can store and use a correct phase difference even if the phase difference Δt has changed while the image forming apparatus is used.

Exemplary components of the image forming apparatus 101 and the laser printer engine 102 related to image processing according to the present exemplary embodiment will be described in detail below with reference to FIG. 13. In the example illustrated in FIG. 13, the components similar to those described above with reference to FIG. 3 are provided with the same reference numerals and symbols. Accordingly, in the following description, the different points from the configuration of the first exemplary embodiment (FIG. 13) only will be described in detail.

Figure 13:
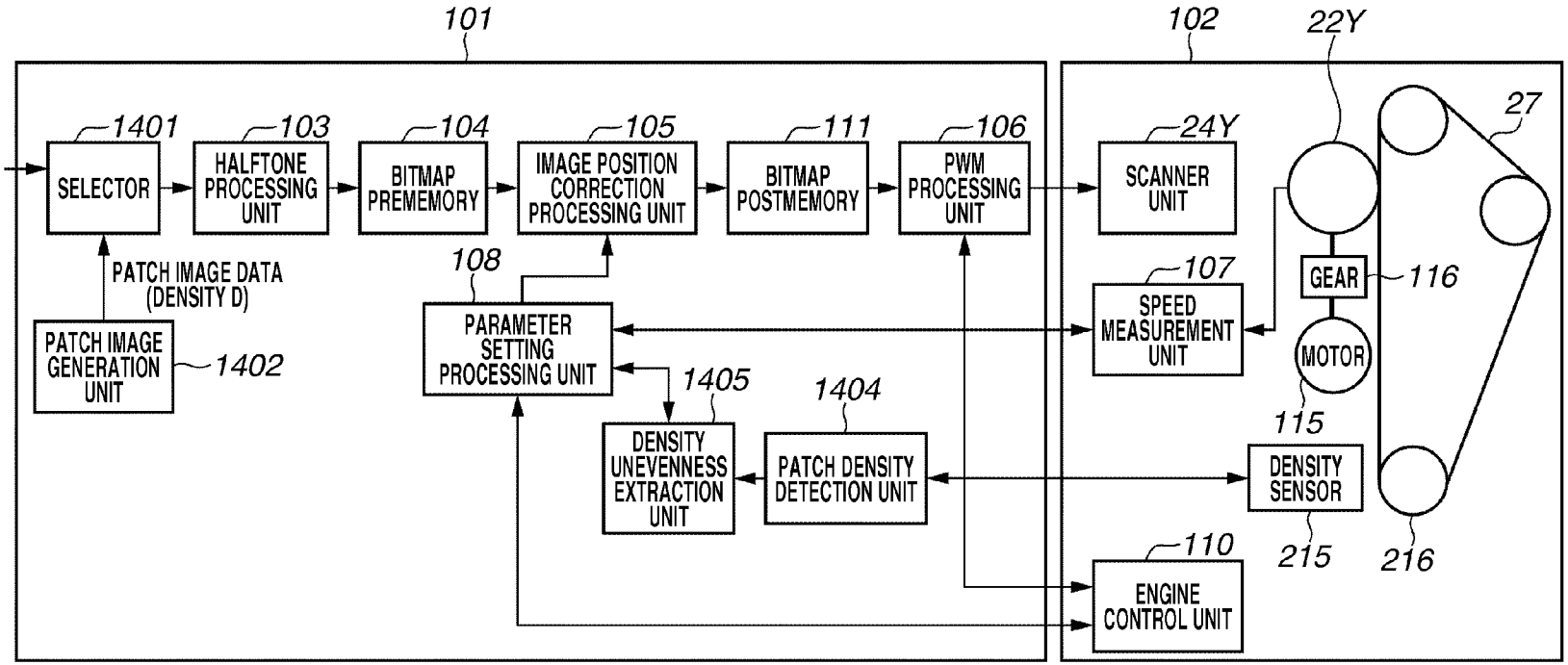
FIG. 13 illustrates exemplary functional blocks of the image forming apparatus.

Referring to FIG. 13, a patch image generation unit 1402 stores image information for forming a detection target image. In addition, the patch image generation unit 1402 controls processing for forming a detection target image, in which a detection target image is formed by using each component downstream of the patch image generation unit 1402. A density sensor 215 is similar to the density sensor described above in the first exemplary embodiment with reference to FIG. 1. The density sensor 215 detects a density of the formed detection target image.

In the example illustrated in FIG. 13, a selector 1401 selects either one of image data input by an external apparatus and image data output by the patch image generation unit (detection target image forming unit) 1402. The selector 1401 outputs the selected image data to the halftone processing unit 103. More specifically, the patch image generation unit 1402 outputs image data to be used for detecting the density D. The detection target image is used for detecting the phase difference Δt, which will be described in detail below.

A patch density detection unit 1404 detects, based on a result of measurement of a density of a patch image on the intermediate transfer member 27 by the density sensor 215, the density of the patch image at the leading edge and the trailing edge thereof. In other words, the patch density detection unit 1404 detects edges of a patch image.

A density unevenness extraction unit 1405 extracts a specific density unevenness component from the detected density of the patch image. The parameter setting processing unit 108 determines an image position correction parameter according to the present exemplary embodiment by calculation.

Now, phase difference calculation processing according to the present exemplary embodiment will be described in detail below with reference to FIG. 14. In the phase difference calculation processing, the phase difference Δt between the rotation speed Vd(t) of the photosensitive member 22Y when the scanner unit 24Y emits a laser beam and the rotation speed Vt(t) when the toner image developed by the laser beam emitted by the scanner unit 24Y is transferred onto the intermediate transfer member 27 is calculated. In the present exemplary embodiment, a phase difference Δtd of the speed unevenness of the rotation cycle Td per one rotation of the photosensitive member 22Y is calculated.

Figure 14:
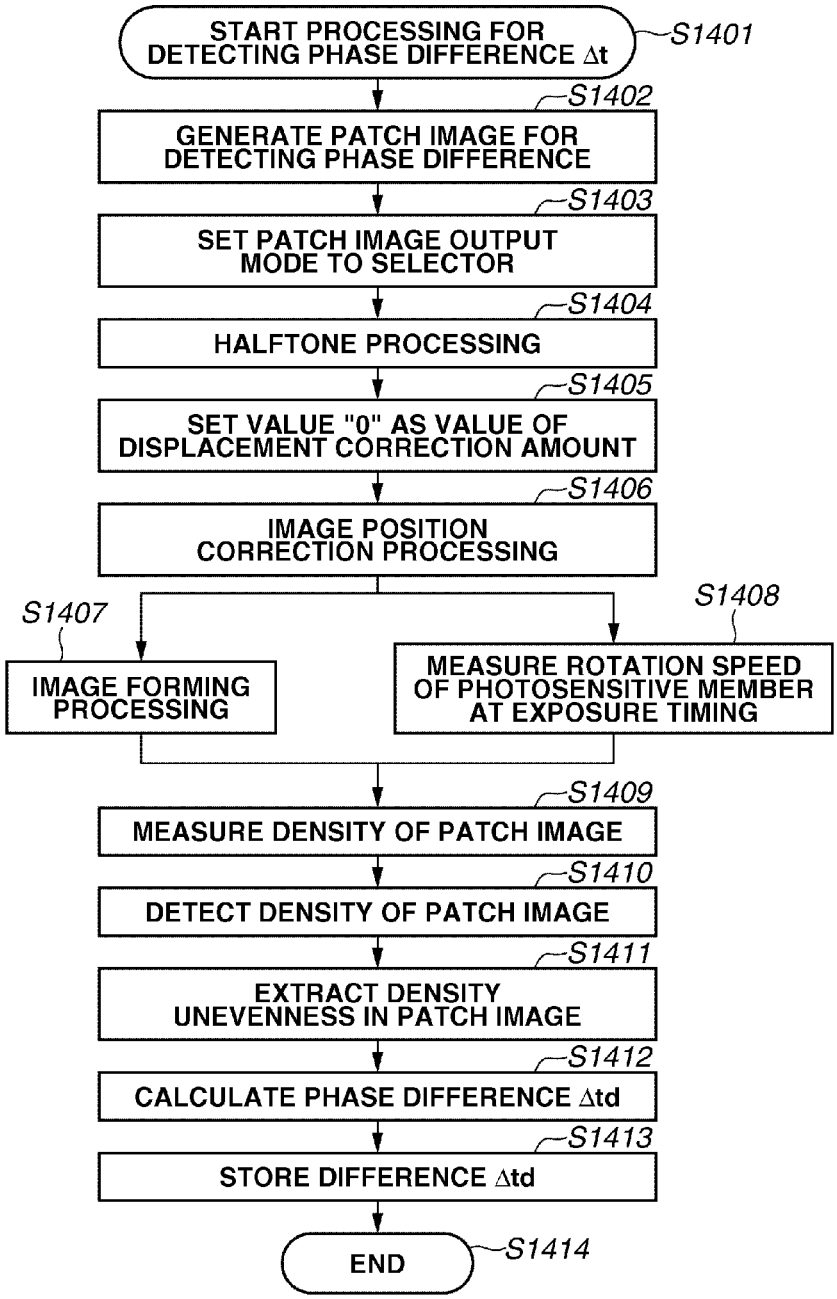
FIG. 14 is a flow chart illustrating an example of phase difference detection processing.

Referring to FIG. 14, in step S1401, processing for detecting the phase difference Δt is started. In step S1402, the patch image generation unit 1402 generates patch image data for detecting the phase difference Δt.

Figure 15A:
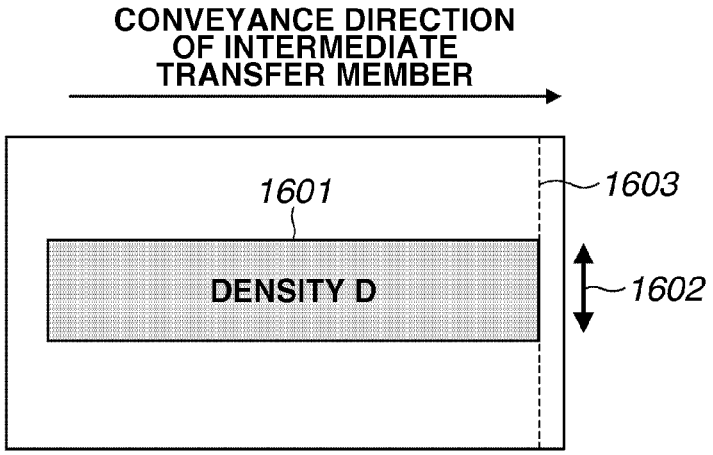
FIGS. 15A through 15C illustrate a phase difference detection method.

An example of a patch image 1601 is illustrated in FIG. 15A. In the example illustrated in FIG. 15A, a patch image having the density D is set within a measurement range 1602 of the density sensor 215. An edge 1603 is the leading edge of the patch image.

In step S1403, to output the generated patch image data to the halftone processing unit 103, the patch image generation unit 1402 sets the mode of the selector 1401 to a patch image output mode. In step S1404, the halftone processing unit 103 executes halftoning by the publicly known multivalued dithering on the input patch image data.

In step S1405, the image position correction processing unit 105 sets a value "0" to the displacement correction amount. In step S1406, the image position correction processing unit 105 executes the image position correction processing described above in the first exemplary embodiment with reference to the flowchart of FIG. 9. Because the displacement correction amount has the value "0" set thereto, the image output in step S1404 is output to the bitmap post-memory 111 as it is.

In step S1407, the PWM processing unit 106 executes processing similar to the image forming processing in S1111 illustrated in FIG. 11 which includes steps S1105-S1110 as in the first exemplary embodiment to form an image. The exposure executable time tp for the image forming is set at time to. At the same time, the speed of the photosensitive member 22Y is measured by using a method similar to the photosensitive member 22Y speed measurement processing in step S402 described above in the first exemplary embodiment to measure the speed of the photosensitive member from the time t0.

In addition, the density unevenness extraction unit 1405 extracts the speed unevenness of the rotation cycle Td per one rotation of the photosensitive member 22Y from the speed of the photosensitive member 22Y measured in step S1408. The speed unevenness can be calculated in the following manner. First, the speed of the photosensitive member 22Y is converted into a frequency space by using a publicly known FFT. Next, the frequency components other than the rotation cycle Td per one rotation of the photosensitive member 22Y are eliminated. Then, the result thereof is subjected to a reverse FFT.

Figure 15B:
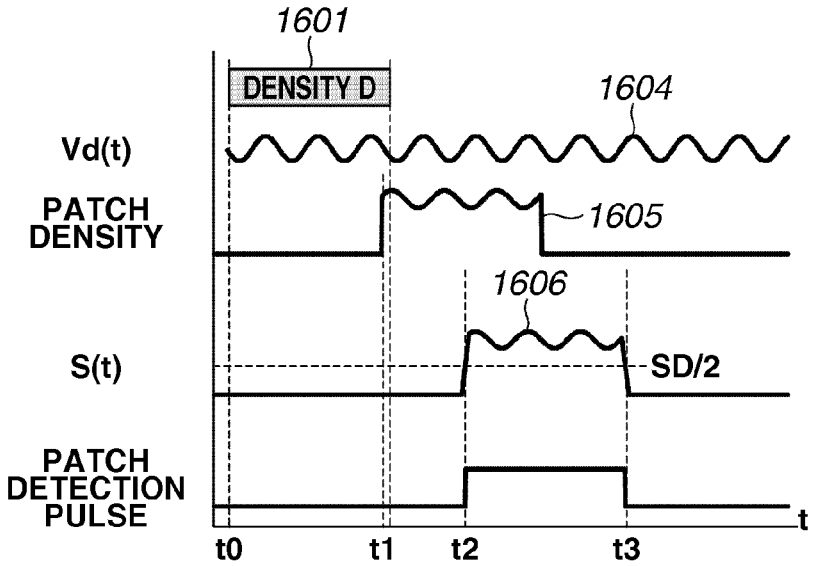
Figure 15C:
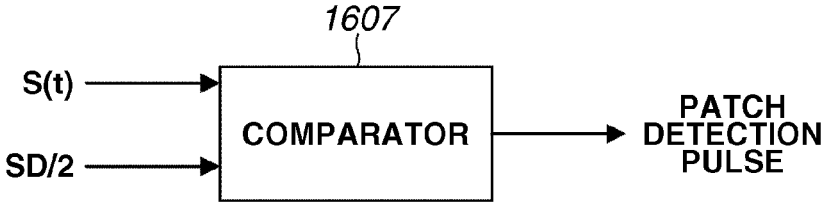

In the example illustrated in FIG. 15B, a speed 1604 is an example of the speed unevenness of the rotation cycle Td per one rotation of the photosensitive member 22Y that has been measured. As described above in the first exemplary embodiment, the speed Vd(t) 1604 is extracted from the surface speed Vdo (t) of the photosensitive member 22Y, which includes the variation of cyclic speed that has various cycles, by executing an analysis by FFT or by filtering.

The exposed patch image 1601 is developed by the development unit 26Y. Then the developed image 1601 is primarily transferred onto the intermediate transfer member 27. As described above, the density of the primarily transferred patch image may vary due to the variation of the speed of the photosensitive member 22Y.

In the example illustrated in FIG. 15B, a density 1605 is an example of the density of the patch image on the intermediate transfer member 27. As described above, the distance Ld between the exposure point 701 and the primary transfer point 702 may vary due to an error in the position of installing the scanner unit 24Y. Accordingly, neither time from the patch image exposure timing to the primary transfer timing nor the phase difference Δtd has been determined yet in the example illustrated in FIG. 15B. Accordingly, neither time t1, which is the timing of primary transfer of the patch image, nor the displacement of the patch image, nor the level of the density 1605 unevenness has been determined yet in the example illustrated in FIG. 15B.

Then the patch image is transferred below the density sensor 215. In step S1409, the density sensor 215 measures an image density S(t) of the image on the intermediate transfer member 27. A density 1606 is an example of the measured image density S(t). Because the patch image has the density D, an average value of the image density S(t) becomes D on the logical basis. In addition, the density S(t) includes density components of various cycles of the rotation cycle per one rotation of the photosensitive member 22Y or the rotation cycle per one rotation of the motor 115.

In the following description, an exemplary method for calculating the time t1, at which the primary transfer of the patch image starts, will be described in detail below.

More specifically, it is necessary to detect the density of the leading edge 1603 of the patch image from the measured image density S(t). In step S1410, the patch density detection unit 1404 detects the density of the leading edge 1603 of the patch image from the value S(t), which is an output of the density sensor 215. In addition, the patch density detection unit 1404 detects the density of the trailing edge of the patch image.

In detecting the density of the patch image, a comparator 1607 compares the density sensor output value S(t) and a patch detection threshold value SD/2. If the density sensor output value S(t) is equal to or smaller than SD/2, the comparator 1607 outputs a "low" level. On the other hand, if the density sensor output value S(t) exceeds SD/2, the comparator 1607 outputs a "high" level.

As illustrated in FIG. 15B, the density sensor output value S(t) exceeds SD/2 at time t2. Therefore, the comparator 1607 outputs the high level signal. Accordingly, the leading edge 1603 of the patch image can be detected. Furthermore, the density sensor output value S(t) becomes equal to or smaller than SD/2 at time t3. Therefore, the comparator 1607 outputs the low level signal. Accordingly, the trailing edge of the patch image can be detected.

As a result, it can be detected that the output value S(t2 and t3) of the density sensor output during a time period from the time t2 to the time t3, in which the patch detection pulse (the output of the comparator 1607) is the high level, is the patch image density.

Figure 16A:
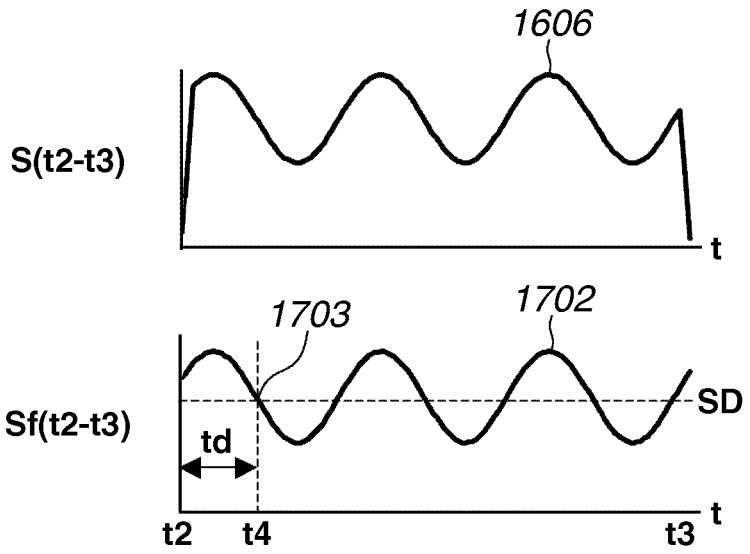
FIGS. 16A and 16B illustrate a phase difference detection method.
Figure 16B:
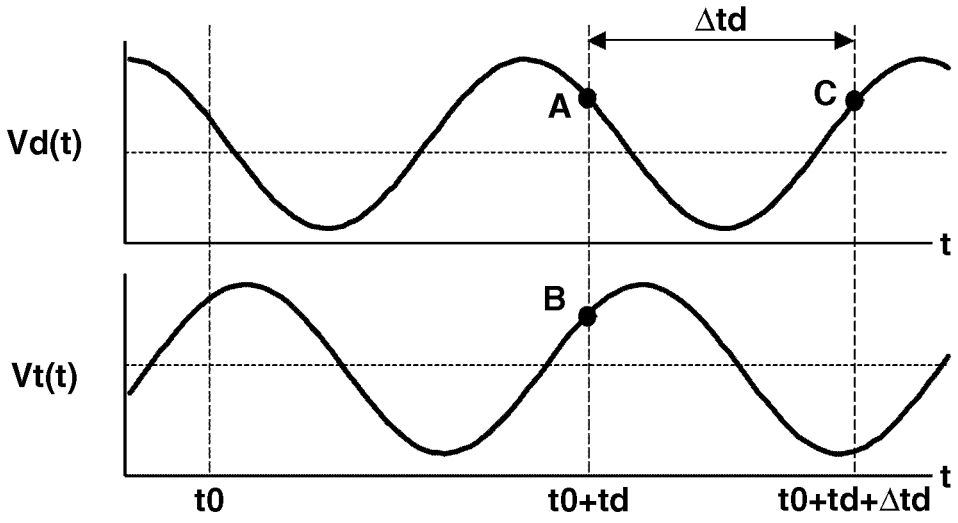

FIGS. 16A and 16B illustrate a magnified example of the output value S(t2 and t3) output by the density sensor 215 during the time period from the time t2 to the time t3. In step S1411, the density unevenness extraction unit 1405 extracts the level of density unevenness of the rotation cycle Td per one rotation of the photosensitive member 22Y from the output value S(t2 and t3) output by the density sensor 215. The level of density unevenness can be calculated in the following manner. More specifically, the speed unevenness can be calculated in the following manner. In other words, first, the output value S(t2 and t3) is converted into a frequency space by using a publicly known FFT. Next, the frequency components other than the rotation cycle Td per one rotation of the photosensitive member 22Y are eliminated. Then, the result thereof is subjected to a reverse FFT.

Referring to FIG. 16A, Sf(t2 and t3) 1702 is a result of the extraction of density unevenness of the rotation cycle Td per one rotation of the photosensitive member 22Y. The Sf(t2 and t3) 1702 indicates that the density detected by the density sensor 215 varies with time since the start of the detection.

In step S1412, the parameter setting processing unit 108 calculates the phase difference Δtd based on the result of extraction of density unevenness on the patch image in step S1411. The calculation executed by the parameter setting processing unit 108 in step S1412 will be described in detail below.

As described above, the patch image having the density D may be displaced due to the speed unevenness of the rotation cycle Td per one rotation of the photosensitive member 22Y. Furthermore, density unevenness of the rotation cycle Td may occur on the patch image having the density D due to the variation of the interval between the lines of the image on the intermediate transfer member 27.

If the actual line interval is the target line interval W, the image density becomes the density D, which is appropriate. On the other hand, if the line interval is less than W, the image is formed with smaller line intervals. Accordingly, the image density becomes higher than the density D in this case. On the other hand, if the line interval is greater than W, the image is formed with a greater line intervals. Accordingly, the image density becomes less than D in this case.

In the example illustrated in FIG. 16A, Sf(t2 and t3)=SD at time t4. In this case, it can be known from FIG. 16A that a line interval Wt(p)=W at this time. In addition, in FIG. 16A, the patch image leading edge 1703, which has been exposed at the time t0, is detected at time t2. Furthermore, at the time t4, which is later than the time t2 by td seconds, the density SD is detected.

More specifically, if the exposure has been executed at time (t0+td), which is later than the time t0 by td seconds, the surface speed Ve(t) of the photosensitive member 22Y and the surface speed Vt(t), which is the surface speed of the photosensitive member 22Y when the exposed image is primarily transferred are the same. This state is illustrated in FIG. 16B by using points A and B.

The above-described state indicates that Vd(t) and Vt(t) are the same based on the mathematical expression (3) as well. Therefore, the following mathematical expression (12) can be satisfied:

$$Ve(t0+td)=Vt(t0+td) \quad (12).$$

Furthermore, because Ve(t)=Vd(t) as expressed by the mathematical expression (3), then the following mathematical expression (13) can be satisfied:

$$Vd(t0+td)=Vt(t0+td) \quad (13).$$

The mathematical expression (13) expresses the following state. At a timing (t0+td) at which the density, that may vary with time since the start of the detection detected by the density sensor 215, has become equivalent to the average density, the rotation speed Vd of the photosensitive member 22Y when the laser beam is emitted and the rotation speed Vt when the toner image formed at the timing of emission of the laser beam based on the latent image is primarily transferred onto the intermediate transfer member 27 have become the same.

Because Vd(t), which is defined by the mathematical expression (2), Vt(t), which is defined by the mathematical expression (4), and an intensity Am of the speed unevenness Vmf(t) of the rotation cycle Tm per one rotation of the motor 115 have the value "0", the following mathematical expression (14) can be satisfied:

$$Vtd+Ad\times\cos\{\omega d\times(t0+td)-\phi dt0\}=Vtd+Ad\times\cos\{\omega d\times(t0+td)-\phi dt0+\Delta td\} \quad (14).$$

The mathematical expressions (13) and (14) express that the surface speed of the photosensitive member 22Y at the time (t0+td) and the surface speed of the photosensitive member 22Y at time (t0+td+Δtd) as illustrated by point C, are the same.

The parameter setting processing unit 108 can calculate a value of Δtd that can satisfy the mathematical expression (14) illustrated in FIG. 16B, based on the surface speed Vd(t) of the photosensitive member 22Y measured in step S1408.

If Δt=0, the surface speed Ve(t) of the photosensitive member 22Y and the surface speed Vt(t) of the photosensitive member 22Y when the exposed image is primarily transferred become the same as each other. More specifically, if Δt=0, it is indicated that Ve(t) and Vt(t) are always the same (Ve(t)=Vt(t)). Accordingly, in this case, it is indicated that no density unevenness has occurred.

In this case, Wt(n) can be defined as follows:

$$Wt(n)\approx We(n)/Vt\{tp+(n-1)ts\}\times Vtd\approx Ve\{tp+(n-1)ts\}\times ts\times Vtd/Vt\{tp+(n-1)ts\}.$$

Therefore, because Ve(t)=Vt(t), then $$Wt(n)\approx ts\times Vtd=W.$$

Therefore, the line interval of the image on the intermediate transfer member 27 may always become equivalent to the target line interval W.

In this state, no image displacement may occur. Accordingly, no density unevenness may occur in this state. Therefore, the state in which Δtd=0 can be identified if the amplitude of the density unevenness is "0" or has a very small value when the density unevenness of the rotation cycle Td per one rotation of the photosensitive member 22Y has been extracted by the density unevenness extraction unit 1405.

After the calculation of the phase difference Δt is completed, the processing advances to step S1413. In step S1413, the parameter setting processing unit 108 stores the extracted phase difference Δtd in the nonvolatile storage unit 109. In step S1414, the processing for detecting the phase difference Δt ends. The processing according to the first exemplary embodiment is executed based on the phase difference Δtd stored as described above.

Processing Executed if Vdt≠Vb

As described above, in the present invention, it is supposed that Vb=Vtd as expressed by the mathematical expression (5). However, the present invention is not limited to this. It is assumed, for example, that the speed Vb of the intermediate transfer member 27 may be higher than the photosensitive drum target speed Vtd by 2%.

In this case, the present exemplary embodiment executes the processing according to the flowchart of FIG. 14. More specifically, the elapsed time td since the time t2 up to the timing at which the average density SD is detected is calculated first. In this case, the expression Wt(t)=W can be satisfied as described above. As expressed by the mathematical expressions (8) and (9), Wt(n)=(Ve(t)×ts/Vt(t))×Vb=W.

Because W and is have a predetermined value and because Vb is greater than Vtd by 2%, the ratio of (Ve/Vt) can be 100/102 reversely thereto. In other words, the following expressions can apply:

$$(Ve/Vt)=100/102$$

$$100/102\times Ve=Vt.$$

Furthermore, the following mathematical expression (15) can be satisfied:

$$(Ve/Vt)=100/102$$

$$100/102\times Ve=Vt.$$

$$100/102\times Vd(t0+td)=Vt(t0+td) \quad (15).$$

The value of td acquired in this case can be used.

In addition, in the present exemplary embodiment, Δt can be calculated by using the mathematical expression (15) similarly to the calculation that uses the mathematical expression (14), as expressed by the following mathematical expression (16):

$$100/102 \times Vd(t0+td)=Vt(t0+td) \quad (16).$$

In addition, in the similar manner, a phase difference Δtm for the variation of the speed of the rotation cycle Tm per one rotation of the motor 115 can be detected. In this case, the phase difference Δtm can be calculated in the following manner. First, the frequency components other than the rotation cycle Tm per one rotation of the motor 115 are eliminated in the processing in step S1408 of the flowchart of FIG. 14. Next, the result thereof is subjected to a reverse FFT. Then, in this case, after extracting the variation of the speed of the rotation cycle Tm per one rotation of the motor 115, the processing in step S1409 and beyond can be executed for the extracted variation of speed.

During the image forming according to the present exemplary embodiment, the mode of the selector 1401 is set to the mode for outputting the image data input by an external apparatus to the halftone processing unit 103. Furthermore, by using the extracted phase difference Δt, the image forming is executed as described above in the first exemplary embodiment.

As described above, according to the present exemplary embodiment, it is not required to measure the phase difference Δt during manufacture of the image forming apparatus. In addition, with the above-described configuration, the present exemplary embodiment can provide the image forming apparatus capable of setting an appropriate phase difference even if the phase difference Δt has varied after the image forming apparatus is manufactured. Furthermore, the present exemplary embodiment having the above-described configuration can provide the image forming apparatus capable of suppressing image degradation that may occur due to density unevenness.

In the first and the second exemplary embodiments described above, the speed measurement unit 107 measures the speed of the photosensitive member 22Y. A third exemplary embodiment of the present invention uses, instead of the speed measurement unit 107, a speed measurement unit built in to the drive motor 115 that calculates the image displacement amount to correct density unevenness, if the variation of the speed occurring on the photosensitive member 22Y has occurred due to the variation of the speed of the drive motor 115. Accordingly, in the present exemplary embodiment, it is not required to use the speed measurement unit 107. Therefore, in the present exemplary embodiment, it is not required to use a device such as a rotary encoder, which may otherwise be used as the speed measurement unit 107.

Figure 17:
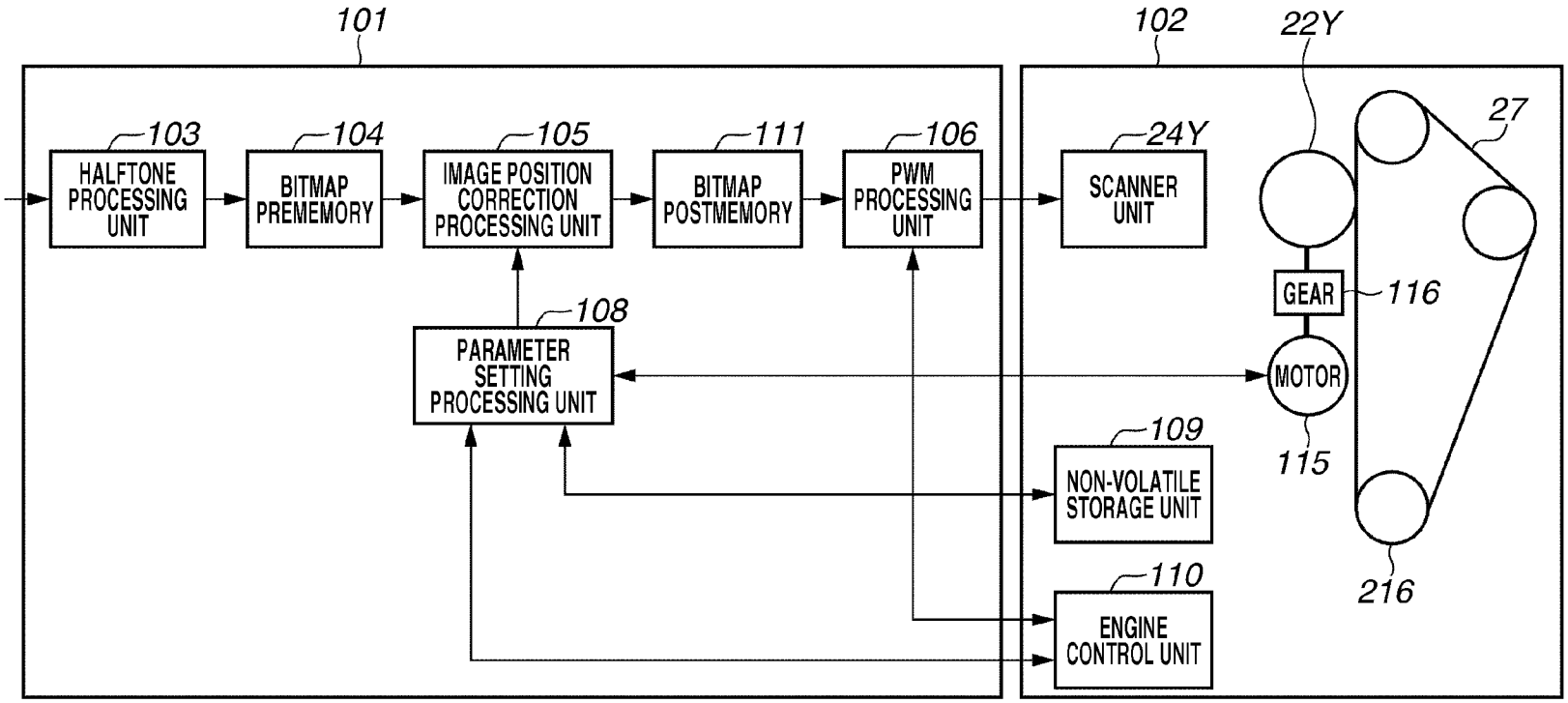
FIG. 17 illustrates exemplary functional blocks of the image forming apparatus.
Figure 18A:
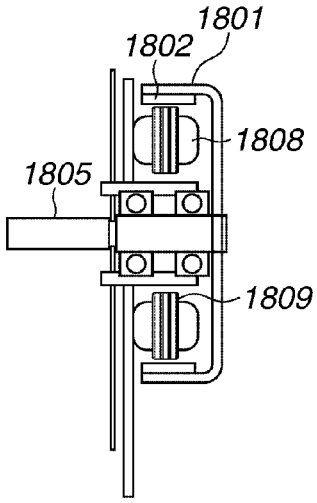
FIGS. 18A through 18E illustrate an exemplary hardware configuration of a motor.
Figure 18B:
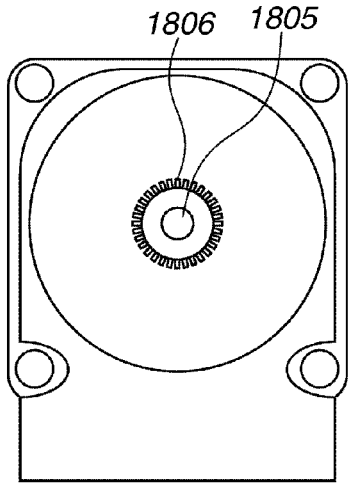
Figure 18C:
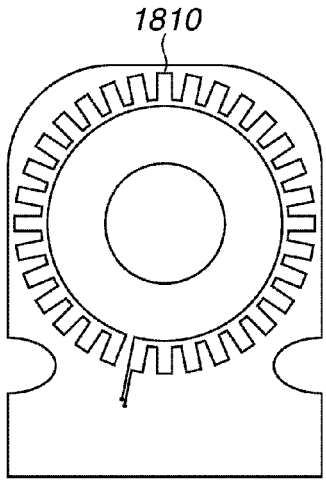
Figure 18D:
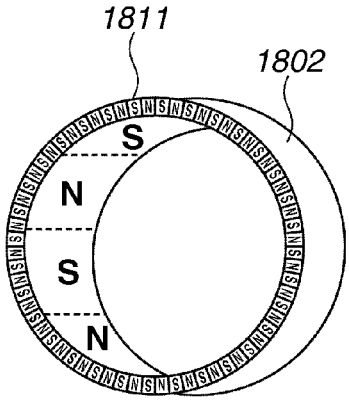
Figure 18E:
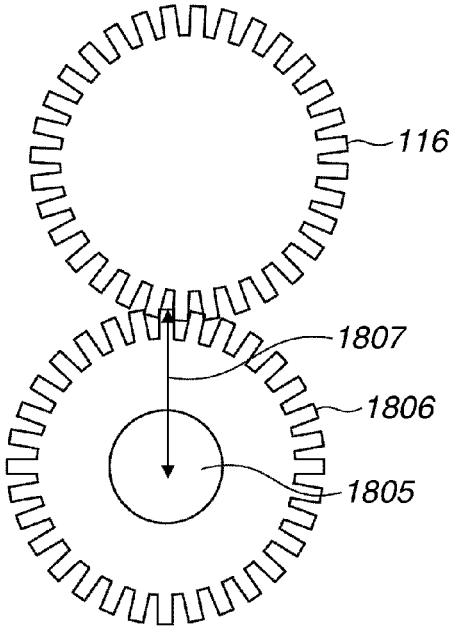

FIG. 17 is a block diagram illustrating exemplary functional units and components of the image forming apparatus 101 according to the present exemplary embodiment. The configuration of the image forming apparatus 101 according to the present exemplary embodiment is similar to the configuration of the first exemplary embodiment illustrated in FIG. 3 except that the speed measurement unit 107 is not included in the example illustrated in FIG. 17. Accordingly, the detailed description of the same configuration as the configuration of the first exemplary embodiment will not be repeated here. In the present exemplary embodiment, as described above, it is not necessary to provide the speed measurement unit 107.

FIGS. 18A through 18E illustrate in detail an exemplary configuration of the motor 115. In FIGS. 18A through 18D, a rotor magnet 1802 is bonded to a rotor frame 1801 from inside the rotor frame 1801. The rotor magnet 1802 is constituted by a permanent magnet. A coil 1809 is wound around a stator 1808. A plurality of stators 1808 are provided around the rotor frame 1801 along the inner periphery 1810 of the rotor frame 1801.

A shaft 1805 externally transmits a rotational force. More specifically, the rotational force is transmitted to a mating gear 116 by using a gear formed by processing the shaft 1805 or by inserting a pinion gear 1806, which is constituted by a resin such as polyoxymethylene (POM), into the shaft 1805.

In the motor illustrated in FIG. 17, a frequency generator (FG) type member, which generates a frequency signal that is proportional to the rotation speed, is employed as the speed measurement unit of the motor. When an FG magnet 1811 rotates integrally with the rotor frame 1801, a sinusoidal signal of a frequency corresponding to the rotation speed is induced by the variation of the magnetic flux, which may occur relatively to the FG magnet 1811. In addition, a control integrated circuit (IC) (not illustrated) compares the generated induction voltage and a predetermined threshold value and generates an FG pulse signal according to a result of the comparison.

Figure 19A:
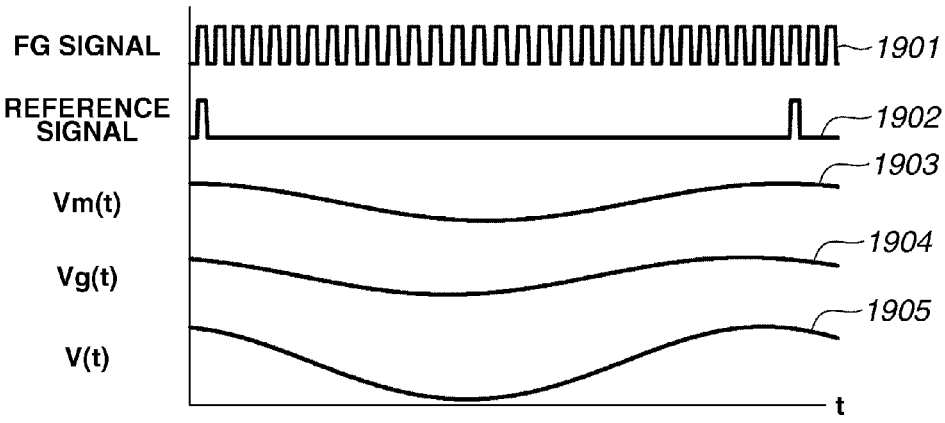
FIGS. 19A and 19B illustrate an example of processing for detecting the rotation speed of the motor.
Figure 19B:
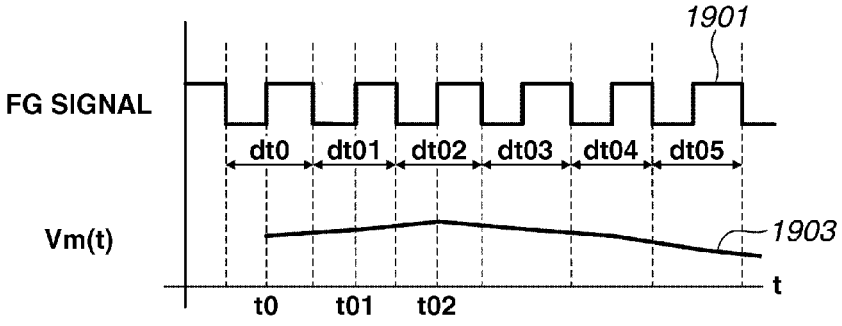

FIGS. 19A and 19B illustrate an example of an FG signal 1901, which is generated when thirty pulses are output per one rotation of the motor. Referring to FIG. 19A, one pulse of a reference signal 1902 is output per one rotation of the motor.

An exemplary method for calculating a motor rotational angle speed Vm(t) based on the FG signal 1901 will be described in detail below with reference to FIG. 19B. More specifically, in the present exemplary embodiment, a motor rotational angle speed Vm(t0), which is the motor rotational angle speed at time t0, is to be measured.

In this case, first, time dt0, which is time required for outputting one pulse of the FG signal 1901 output at the time t0, is measured. Then, the motor rotational angle speed Vm(t0) is calculated by using the following mathematical expression (17):

$$Vm(t0)=1/(mp \times dt0) \quad (17)$$

where "mp" denotes the number of pulses of the FG signal 1901 output per one rotation of the motor. For example, if dt0 is measured in the unit of a second, Vm(t0) is equivalent to the number of the rotation per second (rps) of the motor.

In addition, times dt01, dt02, dt03, dt04, dt05 and the like, which are required for outputting the next one pulse, are serially acquired. Then the calculation by using the mathematical expression (17) is executed. In this manner, the motor rotational angle speed Vm(t) can be measured.

Furthermore, in FIGS. 19A and 19B, a speed 1903 is an example of the motor rotational angle speed Vm(t). For the gear formed on the shaft 1805 and the pinion gear 1806 inserted into the shaft 1805, a distance 1807 from the shaft 1805 to the gear 116, which transmits the rotational force, may vary with the cycle of one rotation. In the present exemplary embodiment, the variation of the distance 1807 is described as "Vg(t)". In the example illustrated in FIG. 19A, the distance 1807 varies as illustrated with a variation Vg(t) 1904. Therefore, the speed V(t) driving the gear 116 can be expressed by the following mathematical expression (18):

$$V(t)=Vm(t) \times Vg(t) \times 2\pi \quad (18).$$

The speed V(t) may vary as illustrated in FIG. 19A with a speed V (t) 1905. As described above, the photosensitive member 22Y is driven by the gear 116. Accordingly, the rotation speed Vd(t) of the photosensitive member 22Y can be expressed as Vd(t)=V(t). More specifically, the rotation speed of the photosensitive member 22Y can be calculated according to a result of the measurement by the speed measurement unit built in to the drive motor 115.

Accordingly, the present exemplary embodiment can calculate the image displacement amount by using the method described above in the first exemplary embodiment and correct density unevenness according to the calculated image displacement amount. In addition, the present exemplary embodiment can be applied to the configuration described above in the second exemplary embodiment, in which the phase difference Δt is detected by using the sensor provided within the image forming apparatus 101.

Accordingly, the present exemplary embodiment having the above-described configuration calculates the image displacement amount by using the speed measurement unit built in to the drive motor 115 and corrects density unevenness according to the calculated image displacement amount. Therefore, it is not necessary to provide a device, such as a rotary encoder, which is used in the first exemplary embodiment.

In addition to various exemplary embodiments of the present invention described above, the present invention can be applied to a system including a plurality of devices (for example, a printer, a facsimile apparatus, a personal computer (PC), or a server apparatus and a client apparatus if the system is a server-client type computer system) and to an apparatus that includes one device.

Furthermore, the present invention is not limited to the automatic adjustment exemplary embodiments. In other words, alternatively, the density of a density unevenness detection patch image, which has been transferred and fixed on a transfer material, can be measured by using an image reading apparatus, such as an image scanner, and a result of the measurement can be utilized in calculating a correction parameter.

Moreover, a part of the processing in steps illustrated in the flowcharts of FIGS. 4, 9, and 11 can be executed by a computer connected and in communication with the image forming apparatus. More specifically, the processing described above with reference to the flowchart of FIG. 11 can be executed by a computer connected and in communication with the image forming apparatus.

In addition, the present invention can be implemented by directly or remotely supplying a program of software implementing functions of the above-described exemplary embodiments to a system or an apparatus and by reading and executing supplied program codes with the system or a computer of the apparatus.

Accordingly, the program code itself, which is installed to the computer for implementing the functional processing of the present invention with the computer, implements the present invention. That is, the present invention also includes the computer program implementing the functional processing of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-125246 filed May 31, 2010, which is hereby incorporated by reference herein in its entirety.

What is claimed is:

1. An image forming apparatus which includes a rotatable photosensitive member, a light emission unit configured to emit a laser beam to the photosensitive member based on image information, and a transfer unit configured to transfer a toner image of an electrostatic latent image formed based on emission of the light emission unit and developed with a toner onto a member onto which an image is to be transferred, the image forming apparatus comprising:

an acquisition unit configured to acquire variable speed information, which indicates a variable rotation speed of the photosensitive member; and an image position correction unit configured to correct an image position according to the variable rotation speed based on the variable speed information that has been acquired by the acquisition unit by executing image processing on the image information.

2. The image forming apparatus according to claim 1, wherein the image position correction unit is configured to execute the image processing on the image information based on the variable rotation speed measured when the laser beam is emitted by the light emission unit and based on the variable rotation speed measured when the toner image developed by the laser beam emitted by the light emission unit is transferred by the transfer unit.

3. The image forming apparatus according to claim 1, wherein the image position correction unit is configured to execute the image processing on the image information based on a phase difference between the variable rotation speed measured when the laser beam is emitted by the light emission unit and the variable rotation speed measured when the toner image developed by the laser beam emitted by the light emission unit is transferred by the transfer unit.

4. The image forming apparatus according to claim 3 further comprising a phase difference calculation unit configured to calculate the phase difference between the variable rotation speed measured when the laser beam is emitted and the variable rotation speed measured when the toner image developed by the laser beam emitted by the light emission unit is transferred.

5. The image forming apparatus according to claim 4, further comprising:

a detection target image forming unit configured to form an image whose density is to be detected on the member to be transferred; and a density detection unit configured to detect the density of a formed detection target image, wherein the phase difference calculation unit is configured to calculate the phase difference based on the variable rotation speed measured when the laser beam is emitted at a timing at which the density detected by the density detection unit, which varies with time from a start of the detection, has reached an average density, and based on the variable rotation speed corresponding to the timing, which is measured when the developed toner image is transferred.

6. The image forming apparatus according to claim 1, further comprising a displacement amount calculation unit configured to calculate an amount of displacement of the image transferred on the member to be transferred based on the variable speed information, wherein the image position correction unit is configured to execute the image processing according to the amount of displacement calculated by the displacement amount calculation unit.

7. The image forming apparatus according to claim 6, wherein the displacement amount calculation unit is configured to calculate the displacement amount of the image based on the variable rotation speed measured when the laser beam is emitted and based on the variable rotation speed measured when the toner image developed by the laser beam emitted by the light emission unit is transferred.

8. The image forming apparatus according to claim 6, wherein the displacement amount calculation unit is configured to calculate the displacement amount based on the variable rotation speed measured at a light emission executable timing, which is a timing for permitting the emission of the laser beam in synchronization with a position of a printable region.

9. The image forming apparatus according to claim 1, wherein a cycle of the variable rotation speed is a cycle of the photosensitive member or a cycle of a motor configured to drive the photosensitive member.

10. The image forming apparatus according to claim 1, wherein the image processing includes image processing for moving a barycenter of the image.

11. A computer-readable storage medium storing instructions which, when executed by a computer configured to generate image information to be processed by an image forming apparatus which includes a rotatable photosensitive member, a light emission unit configured to emit a laser beam to the photosensitive member based on the image information, and a transfer unit configured to transfer a toner image of an electrostatic latent image formed based on emission of the light emission unit and developed with a toner onto a member onto which an image is to be transferred, cause the computer to perform operations comprising:

acquiring variable speed information, which indicates a variable rotation speed of the photosensitive member; and correcting an image position according to the variable rotation speed based on the acquired variable speed information by executing image processing on the image information.

12. An image forming apparatus which includes a rotatable photosensitive member, a light emission unit configured to emit a laser beam to the photosensitive member based on image information, and a transfer unit configured to transfer a toner image of an electrostatic latent image formed based on emission of the light emission unit and developed with a toner onto a member onto which an image is to be transferred, the image forming apparatus comprising:

an acquisition unit configured to acquire variable speed information, which indicates a variable rotation speed of the photosensitive member; and an image position correction unit configured to correct an image position determined by the image information based on the variable speed information acquired by the acquisition unit by executing image processing on the image information.

13. A non-transitory computer-readable storage medium storing instructions which, when executed by a computer configured to generate image information to be processed by an image forming apparatus which includes a rotatable photosensitive member, a light emission unit configured to emit a laser beam to the photosensitive member based on the image information, and a transfer unit configured to transfer a toner image of an electrostatic latent image formed based on emission of the light emission unit and developed with a toner onto a member onto which an image is to be transferred, causes the computer to perform operations comprising:

acquiring variable speed information, which indicates a variable rotation speed of the photosensitive member; and correcting an image position determined by the image information based on the acquired variable speed information by executing image processing on the image information.

* * * * *